US008436536B2

(12) United States Patent
Deguchi et al.

(10) Patent No.: US 8,436,536 B2
(45) Date of Patent: May 7, 2013

(54) VEHICLE DISCHARGE LAMP, VEHICLE DISCHARGE LAMP DEVICE, LIGHTING CIRCUIT COMBINED TYPE VEHICLE DISCHARGE LAMP DEVICE, AND LIGHTING CIRCUIT

(75) Inventors: Makoto Deguchi, Imabari (JP); Osamu Shirakawa, Imabari (JP); Masahiro Doi, Imabari (JP); Kosuke Ueda, Imabari (JP); Takuya Abe, Imabari (JP)

(73) Assignee: Harison Toshiba Lighting Corporation, Imabari-shi, Ehime (JP)

( * ) Notice: Subject to any disclaimer, the term of this patent is extended or adjusted under 35 U.S.C. 154(b) by 0 days.

(21) Appl. No.: 13/254,997

(22) PCT Filed: Mar. 4, 2010

(86) PCT No.: PCT/JP2010/001519

§ 371 (c)(1),
(2), (4) Date: Nov. 23, 2011

(87) PCT Pub. No.: WO2010/100935

PCT Pub. Date: Sep. 10, 2010

(65) Prior Publication Data

US 2012/0056539 A1 Mar. 8, 2012

(30) Foreign Application Priority Data

| | | |
|---|---|---|
| Mar. 6, 2009 | (JP) | 2009-053980 |
| Apr. 23, 2009 | (JP) | 2009-105325 |
| Apr. 30, 2009 | (JP) | 2009-110266 |
| May 13, 2009 | (JP) | 2009-116304 |
| Jun. 25, 2009 | (JP) | 2009-151196 |
| Jun. 25, 2009 | (JP) | 2009-151197 |
| Jun. 26, 2009 | (JP) | 2009-152041 |
| Oct. 22, 2009 | (JP) | 2009-243474 |
| Oct. 27, 2009 | (JP) | 2009-246662 |
| Oct. 27, 2009 | (JP) | 2009-246663 |
| Nov. 4, 2009 | (JP) | 2009-253182 |
| Nov. 26, 2009 | (JP) | 2009-268959 |

(51) Int. Cl.
*H01J 61/30* (2006.01)

(52) U.S. Cl.
USPC ..... 313/570; 313/634; 313/637

(58) Field of Classification Search ..... 313/570, 313/17, 310, 567, 621, 623, 634, 633, 573, 313/637, 635
See application file for complete search history.

(56) References Cited

FOREIGN PATENT DOCUMENTS

| | | |
|---|---|---|
| JP | 2004-172056 | 6/2004 |
| JP | 2008-016434 | 1/2008 |
| JP | 2008-084550 | 4/2008 |
| JP | 2009-043446 | 2/2009 |
| WO | 2007/013530 | 2/2007 |

OTHER PUBLICATIONS

Translation of the International Preliminary Report on Patentability in corresponding International Application No. PCT/JP2010/001519.
International Search Report corresponding to International Application No. PCT/JP2010/001519.

*Primary Examiner* — Joseph L Williams
(74) *Attorney, Agent, or Firm* — Banner & Witcoff, Ltd.

(57) ABSTRACT

A mercury-free vehicle discharge lamp is described as including a discharge space with electrodes, wherein a spherical length b, which is a length in a tube axial direction of the light emitting part is 7.5 mm to 8.5 mm and a thickness volume V of the light emitting part is 50 $mm^3$ to 100 $mm^3$, and wherein the following formula is satisfied: $-20 \leqq (a-35)\times 5.5+(x-13.5)\times 10+(1.85-t)\times 100+(2.5-d)\times 100 \leqq 20$, a: power W supplied in a stable lighting time, x: pressure [atm] of rare gas sealed in the discharge space ranging 10~17 atm, t: thickness [mm] of a part where a wall with maximum thickness and ranging 1.30~1.85 mm, and d: inner diameter [mm] of a part where the wall with maximum thickness.

12 Claims, 20 Drawing Sheets

FIG.9

| | $Xe$ PRESSURE | INNER DIAMETER OF LIGHT EMITTING TUBE | WALL THICKNESS OF LIGHT EMITTING TUBE | POWER | TEMPERATURE VARIATION AMOUNT | LIGHT EMISSION EFFICIENCY | INITIAL LIGHT FLUX | MAINTENANCE FACTOR OF LIGHT FLUX AFTER 2000h | JUDGMENT | REMARKS |
|---|---|---|---|---|---|---|---|---|---|---|
| | [atm] | [mm] | [mm] | [W] | [⊿°C] | [lm/W] | [lm] | [%] | | |
| COMPARATIVE EMBODIMENT | 13.5 | 2.5 | 1.85 | 35 | 0 | 91 | 3200 | 80 | ○ | |
| TEST (1) | 13.5 | 2.5 | 1.85 | 30 | −28 | 77 | 2300 | 85 | ○ | |
| | 13.5 | 2.5 | 1.85 | 25 | −55 | 64 | 1600 | 90 | × | LOW LIGHT EMISSION EFFICIENCY |
| | 13.5 | 2.5 | 1.85 | 20 | −83 | 50 | 1000 | 90 | × | LOW LIGHT EMISSION EFFICIENCY |
| TEST (2) | 13.5 | 2.5 | 1.30 | 30 | 28 | 100 | 3000 | 70 | ○ | |
| | 13.5 | 2.5 | 1.30 | 25 | 0 | 88 | 2200 | 85 | ○ | |
| | 13.5 | 2.5 | 1.30 | 20 | −28 | 75 | 1500 | 85 | △ | LOW TOTAL LIGHT FLUX |
| TEST (3) | 13.5 | 2.0 | 1.85 | 30 | 23 | 97 | 2800 | 70 | ○ | |
| | 13.5 | 2.0 | 1.85 | 25 | −5 | 84 | 2100 | 80 | ○ | |
| | 13.5 | 2.0 | 1.85 | 20 | −33 | 75 | 1500 | 85 | △ | LOW TOTAL LIGHT FLUX |
| TEST (4) | 13.5 | 2.0 | 1.30 | 30 | 78 | 122 | 3650 | OCCURRENCE OF LEAK | × | OCCURRENCE OF LEAK |
| | 13.5 | 2.0 | 1.30 | 25 | 50 | 110 | 2750 | 60 | × | LOW LIGHT FLUX MAINTENANCE FACTOR |
| | 13.5 | 2.0 | 1.30 | 20 | 23 | 98 | 1950 | 70 | ○ | |
| TEST (5) | 10.0 | 2.5 | 1.85 | 30 | −63 | 58 | 1750 | 90 | × | LOW LIGHT EMISSION EFFICIENCY |
| | 10.0 | 2.5 | 1.85 | 25 | −90 | 48 | 1200 | 90 | × | LOW LIGHT EMISSION EFFICIENCY |
| | 10.0 | 2.5 | 1.85 | 20 | −118 | 35 | 700 | 90 | × | LOW LIGHT EMISSION EFFICIENCY |
| TEST (6) | 17.0 | 2.5 | 1.30 | 30 | 63 | 117 | 3500 | OCCURRENCE OF LEAK | × | OCCURRENCE OF LEAK |
| | 17.0 | 2.5 | 1.30 | 25 | 35 | 104 | 2800 | 85 | ○ | |
| | 17.0 | 2.5 | 1.30 | 20 | 8 | 90 | 1800 | 80 | ○ | |
| TEST (7) | 10.0 | 2.0 | 1.85 | 30 | −13 | 83 | 2500 | 85 | ○ | |
| | 10.0 | 2.0 | 1.85 | 25 | −40 | 70 | 1750 | 90 | △ | LOW TOTAL LIGHT FLUX |
| | 10.0 | 2.0 | 1.85 | 20 | −68 | 58 | 1150 | 90 | × | LOW LIGHT EMISSION EFFICIENCY |
| TEST (8) | 17.0 | 2.0 | 1.30 | 30 | 113 | 137 | 4100 | OCCURRENCE OF LEAK | × | OCCURRENCE OF LEAK |
| | 17.0 | 2.0 | 1.30 | 25 | 85 | 126 | 3150 | OCCURRENCE OF LEAK | × | OCCURRENCE OF LEAK |
| | 17.0 | 2.0 | 1.30 | 20 | 58 | 115 | 2300 | 60 | × | LOW LIGHT FLUX MAINTENANCE FACTOR |

FIG.10

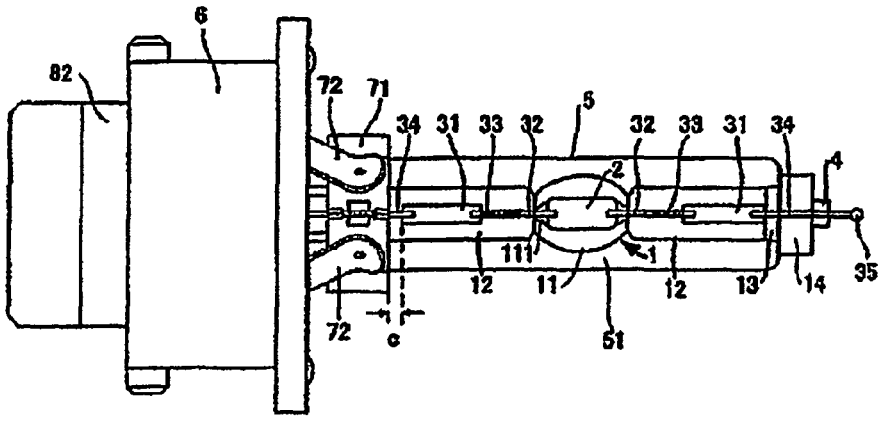

| CURRENT SLOPE OF ZERO CROSS CURRENT [A/μs] | FREQUENCY [Hz] | PRESENCE/ ABSENCE OF GENERATION OF FLICKERING | REMARKS |
|---|---|---|---|
| 0.03 | 400 | × | |
| 0.05 | 400 | ○ | |
| 0.10 | 400 | ○ | |
| 0.20 | 400 | ○ | |
| 0.25 | 400 | ○ | |

| CURRENT SLOPE OF ZERO CROSS CURRENT [A/μs] | FREQUENCY [Hz] | PRESENCE/ ABSENCE OF GENERATION OF FLICKERING | REMARKS |
|---|---|---|---|
| 0.05 | 100 | ○ | ALTHOUGH NO FLICKERING OCCURS, SERVICE LIFE IS SHORT |
| 0.05 | 200 | ○ | |
| 0.05 | 400 | ○ | |
| 0.05 | 500 | ○ | |
| 0.05 | 700 | × | |

FIG.27A
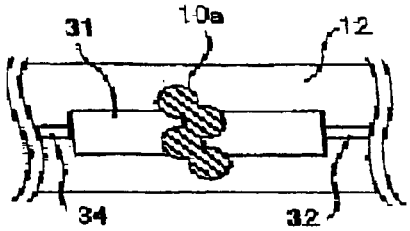
FIG.27B
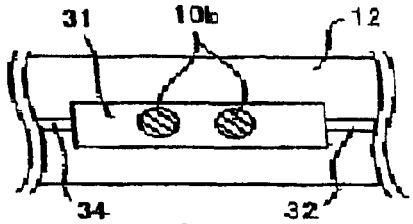
(a)
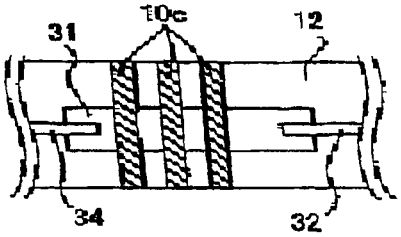
(b)
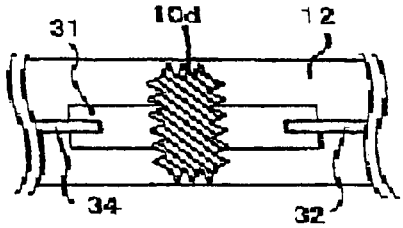
FIG.27C
FIG.27D
FIG.28A
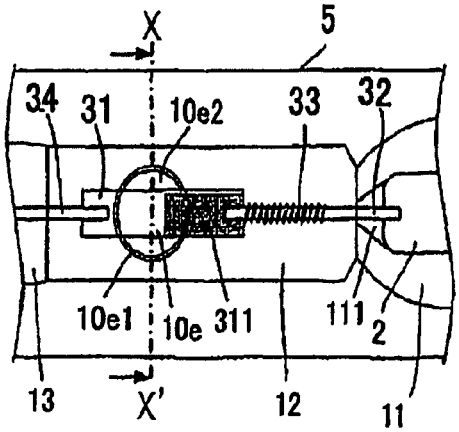
FIG.28B
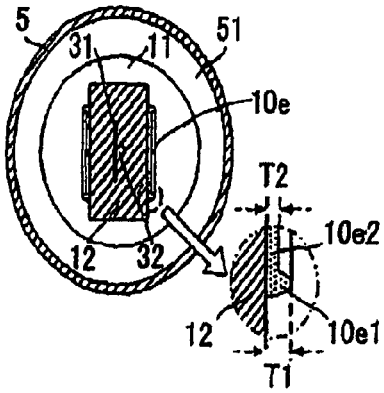

FIG.29
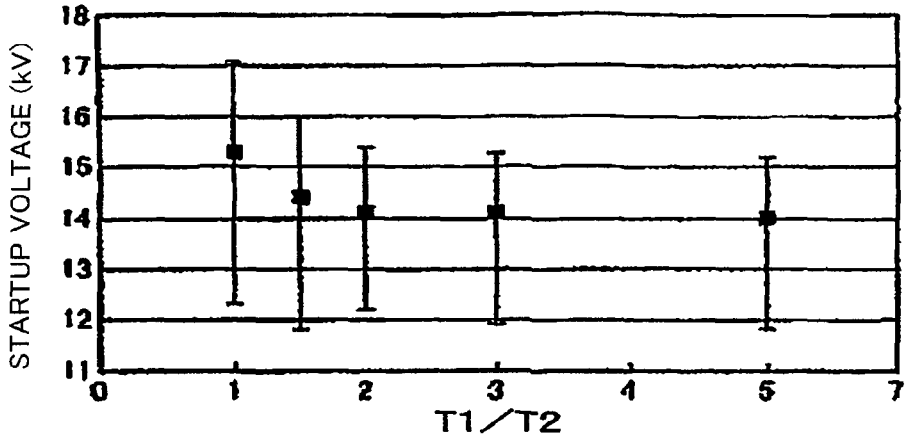
FIG.30
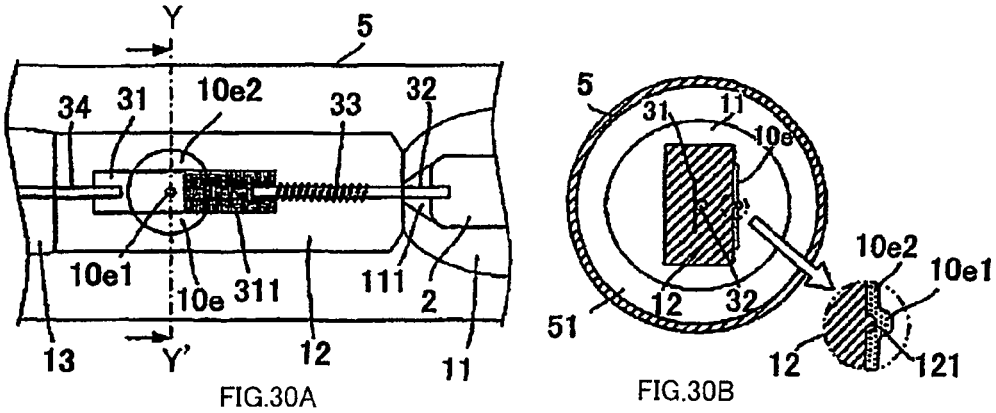
FIG.30A
FIG.30B

VEHICLE DISCHARGE LAMP, VEHICLE DISCHARGE LAMP DEVICE, LIGHTING CIRCUIT COMBINED TYPE VEHICLE DISCHARGE LAMP DEVICE, AND LIGHTING CIRCUIT

TECHNICAL FIELD

The present invention relates to a vehicle discharge lamp used in a headlight, etc., of an automobile, and to a so-called mercury-free discharge lamp not utilizing mercury for discharge in a light emitting part.

BACKGROUND ART

At present, a discharge lamp used as an automobile headlight, is designed to be lighted at about 35 W in a stable lighting time. Such alighting condition is employed for achieving required total light flux, light distribution, and light emission efficiency, and also securing stable lighting. However, there is an increased market needs for an automobile further improved in fuel efficiency, from a concern for a global environment. Further, electric vehicles and automobiles such as a hybrid car with low environmental load utilizing an electric motor as a power source, are popular and spread, and a reduction of power consumption is further strongly desired for on-vehicle lighting such as a headlight.

When a lighting power input into a lamp is only reduced, the total light flux of the lamp is reduced accordingly and the light emission efficiency is also reduced, and therefore an expected performance can not be secured. Accordingly, development of a new lamp capable of satisfying the market needs even at a low power, is desired.

Regarding an automobile headlight for achieving a stable lighting at a low power of 15 to 30 W, Patent document 1 discloses a technique of solving the above-described problem by optimizing a sealed pressure in the light emitting part and an inner diameter of the light emitting part. However, sufficient light emission efficiency can not be obtained only by conditions provided by this document. Therefore, further improvement is desired.

CITATION LIST

Patent Literature

PLT 1: Japanese Patent Application Laid-Open No. 2004-172056

SUMMARY OF THE INVENTION

Technical Problem

An object of the present invention is to provide a practical new vehicle discharge lamp capable of achieving required light emission efficiency even at a low power of 30 W or less.

Solution to Problem

The present invention provides a mercury-free discharge lamp, which is a vehicle discharge lamp lighted stably at a power of 18 to 30 W in a stable lighting time without substantially using mercury, including a discharge space which is defined in a light emitting part, into which a discharge medium containing metal halide and rare gas are sealed, and in which electrodes are arranged, satisfying the following formula 1.

$$-40 \leqq (a-35)\times 5.5+(x-13.5)\times 10+(1.85-t)\times 100+(2.5-d)\times 100 \leqq 40 \quad \text{(Formula 1)}$$

wherein a: Power [W] supplied in the stable lighting time, satisfying $18 \leqq a \leqq 30$ x: Pressure of the rare gas sealed in the discharge space [atm]

t: Thickness of a part where a wall thickness of the light emitting part is maximum [mm]

d: Inner diameter of a part where a wall thickness of the light emitting part is maximum [mm]

Advantageous Effects of Invention

According to the present invention, various design conditions for achieving stable lighting at a low power, can be optimized by a simple method, and accordingly, a vehicle discharge lamp based on a desired specification can be provided.

BRIEF DESCRIPTION OF THE DRAWINGS

FIG. 9 is a table showing test results of a lamp with each parameter varied in accordance with a concept of the present invention, and evaluation of characteristics.

FIG. 10 is a view for explaining a discharge lamp according to a second embodiment of the present invention.

FIG. 27 is a view for describing other embodiment of the conductive coating film.

FIG. 28 is a view for describing a discharge lamp according to a seventh embodiment of the present invention.

FIG. 29 is a view showing a relation between T1/T2 and the startup voltage.

FIG. 30 is a view for describing other embodiment of the conductive coating film.

DESCRIPTION OF EMBODIMENTS (First Embodiment)

Figure 1:
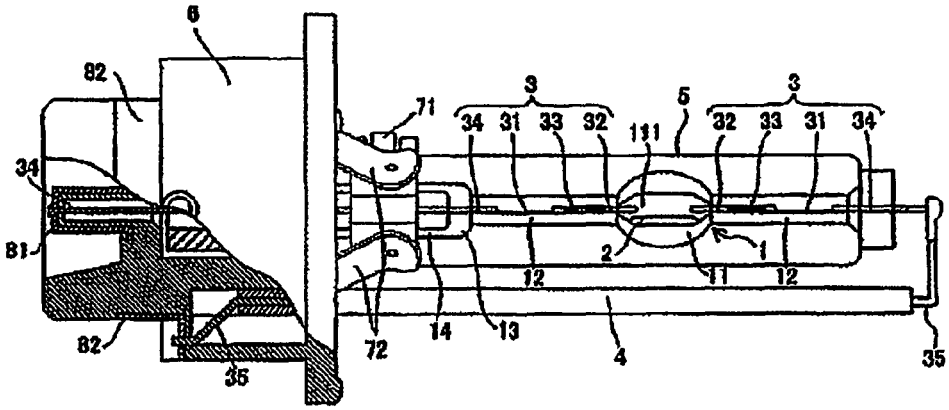
FIG. 1 is a view for explaining a discharge lamp according to a first embodiment of the present invention.
Figure 2:
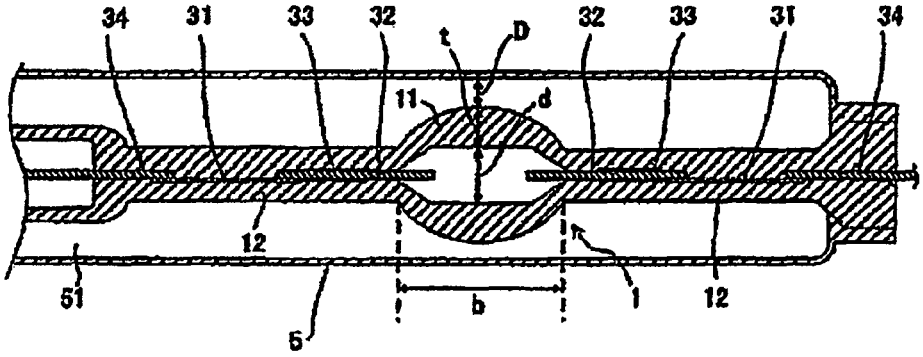
FIG. 2 is an expanded partial sectional view of an essential part of the discharge lamp shown in FIG. 1.

An example of the embodiments of the present invention will be described, with reference to FIG. 1 and FIG. 2. FIG. 1 is an overall view for describing an embodiment of a discharge lamp according to the present invention, and FIG. 2 is an expanded partial sectional view of an essential part of the discharge lamp shown in FIG. 1, viewed from a different angle of about 90 degrees from FIG. 1.

The discharge lamp of this embodiment can be used as a light source of an automobile headlight, and includes an elongated inner tube 1. A substantially elliptic hollow light emitting part 11 is formed in the vicinity of a center of the inner tube 1. Plate-like sealing parts 12 formed by pinch seal, are formed on both ends of the light emitting part 11, and cylindrical parts 14 are continuously formed on the both ends of each sealing part 12 via a boundary part 13. Note that the inner tube 1 is preferably made of a material having heat resistant property and light transmitting property, such as quartz glass. Further, the sealing part 12 may have a cylindrical shape formed by shrink seal.

A discharge space 111 is formed in the light emitting part 11, with a center having approximately a cylindrical shape, in such a manner as being tapered toward both ends. Volume of the discharge space 111 is generally 10 to 40 $mm^3$ and particularly 20 to 30 $mm^3$, when being used for the automobile headlight.

A discharge medium is sealed in the discharge space 111. At least a metal halide 2 and inert gas are contained in the discharge medium.

The metal halide 2 is made of halide of sodium, scandium, zinc, and indium. For example, iodine is used as halogen that constitutes the metal halide, although not limited thereto, and bromine and chlorine may also be used by combining them. Further, a combination of the metal halide is not limited thereto, and halide of tin and cesium may be arbitrarily added. A sealing amount of the metal halide per unit volume may be set to 0.008 to 0.016 mg/μl, for example.

For example, xenon is used as the inert gas sealed in the discharge space 111. A sealed pressure of the inert gas can be adjusted according to a purpose of use. For example, in order to increase the characteristic of the total light flux, etc., the sealed pressure is preferably set to 10 to 20 atm at a normal temperature (25° C.). Further, neon, argon, and krypton, etc., can be used other than xenon, and a mixed gas of combining them can also be used.

Wherein, the discharge medium not substantially containing mercury is preferable. Regarding the description "without substantially using mercury . . . " in this specification should be interpreted as the meaning, without being limited to a case where an sealing amount of mercury is 0 mg, including a case that the mercury is sealed with an sealing amount approximately equal to an amount almost not sealed, compared with a conventional discharge lamp having mercury therein, for example, an amount of less than 2 mg per 1 ml, and preferably 1 mg or less.

Electrode mounts 3 are respectively air-tightly sealed to the sealing parts 12 formed on the both sides of the light emitting part 11. Each electrode mount 3 is constituted of a metal foil 31, an electrode 32, a coil 33, and a lead wire 34.

The metal foil 31 is a thin plate-like member made of molybdenum for example.

The electrode 32 is a rod-like member constituted of so-called thoriated tungsten obtained by, for example, doping tungsten with thorium oxide. One end thereof is welded to an end portion on the light emitting part 11 side of the metal foil 31 in such a manner as being placed thereon, and the other end protrudes into the discharge space 111, with tip ends of the electrodes 32 face to each other while keeping a prescribed distance therebetween. For example, each electrode 32 can be positioned in a range of 3.7 to 4.4 mm of the distance between the tip ends of the electrodes 32, when observed through an outer tube 5, for the purpose of use for the automobile headlight for example. Note that a shape of the electrode 32 is not limited to a straight rod shape with a diameter approximately constant in a tube axial direction, and may be a non-straight-rod-like shape with a diameter of a tip end portion set to be larger than a diameter of a base end portion, or may be a shape with a spherical tip end, and may be a shape with a diameter of one electrode and a diameter of the other electrode different from each other like a direct-current lighting type. Further, an electrode material may be pure tungsten, doped tungsten, and rhenium tungsten, etc.

For example, the coil 33 is a metal wire made of doped tungsten, and is spirally wound on an axis portion of the electrode 32 around the axis, the electrode 32 being air-tightly sealed to the sealing part 12. The coil 33 can be designed so that a coil wire diameter is set to 30 to 100 μm, and a coil pitch is set to 600% or less.

The lead wire 34 is a metal wire made of molybdenum for example. An end of the lead wire 34 is connected to an end portion of the metal foil 31 on a side far from the light emitting part 11 in such manner as being placed thereon, and the other end is extended approximately in parallel to a tube axis up to outside of the inner tube 1. For example, one end of an L-shaped support wire 35 made of nickel is connected by laser welding, to the lead wire 34 extended to a front end side of the lamp, namely, to a side far from a socket 6. For example, a sleeve 4 made of ceramics is mounted on a part of the support wire 35 extending in parallel to the inner tube 1.

The cylindrical outer tube 5 is concentrically provided to outside of the inner tube 1 thus constructed, so as to cover the light emitting part 11. Such connection between the inner and outer tubes is made by welding both ends of the outer tube 5 to the vicinity of the cylindrical part 14 of the inner tube 1. Gas is sealed in a closed space 51 formed between the inner tube 1 and the outer tube 5. As such gas, dielectric barrier discharge gas, and for example, one kind of gas selected from neon, argon, xenon, and nitrogen, or mixed gas thereof can be used. A pressure of the gas is preferably set to 0.3 atm or less, and particularly 0.1 atm or less. The outer tube 5 is preferably formed by a material having thermal expansion coefficient close to that of the inner tube 1, and having UV-blocking property. Then, quartz glass added with oxide such as titanium, cerium, and aluminum can be used for the outer tube 5.

The socket 6 is connected to one end of the inner tube 1 to which the outer tube 5 is connected. Such a connection is made by mounting a metal band 71 on an outer peripheral surface of the outer tube 5, and grasping the metal band 71 by metal ligulas 72 which are formed so as to protrude from the socket 6. Further, a bottom terminal 81 is formed on a bottom of the socket 6, and a side terminal 82 is formed on a side portion thereof, and the lead wire 34 and the support wire 35 are connected to the bottom terminal 81 and the side terminal 82.

The discharge lamp thus constructed is connected to a lighting circuit (see FIG. 13) so that the bottom terminal 81 is positioned on a higher pressure side, and the side terminal 82 is positioned on a lower pressure side. When being used as the automobile headlight, the discharge lamp is attached and lighted, so that the tube axis of the lamp is set in approximately a horizontal state, and the support wire 35 is positioned in a lower part.

Figure 3:
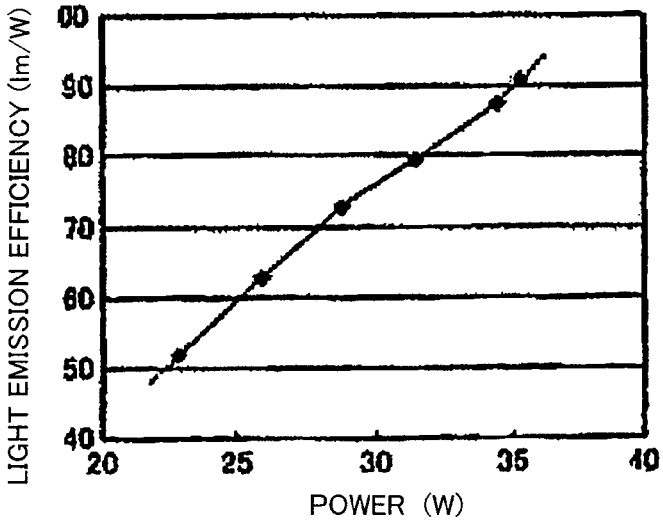
FIG. 3 is a view showing a relation between power supplied to a lamp, and light emission efficiency.

In a conventional mercury-free discharge lamp, total light flux of 3200 lm is obtained by lighting at a power of 35 W in a steady time. The light emission efficiency calculated therefrom is about 911 m/W. However, as described above, when the power applied to the lamp is simply reduced, the light emission efficiency is reduced accordingly (FIG. 3).

Figure 4:
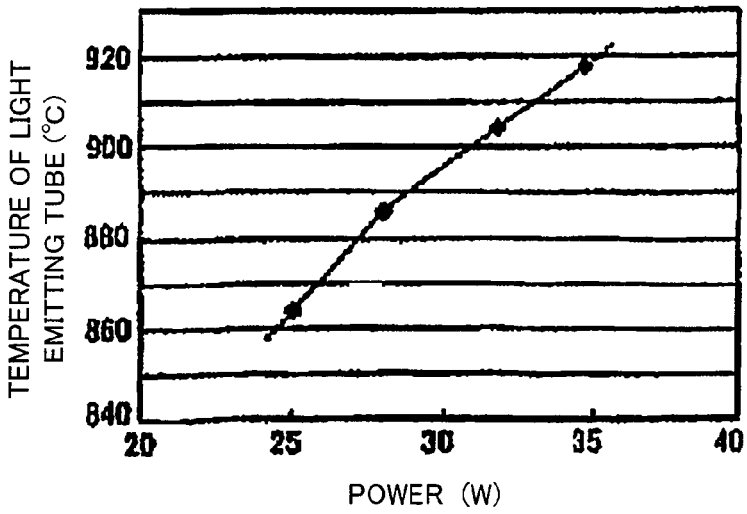
FIG. 4 is a view showing a relation between power at a lighting time and a temperature of an upper part of a light emitting part.

As a result of strenuous efforts and study by inventors of the present invention, it is found that there is a relevance between the light emission efficiency of the lamp and the temperature of the light emitting part. FIG. 4 is a graph for plotting the test results, with power input into the lamp during lighting taken on a horizontal axis, and the temperature of the light emitting part taken on a vertical axis. It is found from this graph that the temperature of the light emitting part is reduced when the power of the lamp is reduced. Note that the temperature of the light emitting part called here, can be obtained by measuring the temperature of an upper side part of the light emitting part 11 on a paper face of FIG. 1. In FIG. 1, when the lamp is lighted, with the sleeve 4 placed downward as shown in FIG. 1, an arc is generated between the electrodes so as to be warped upward. Therefore, an increase of the temperature in an upper part of the light emitting part is remarkable, if compared with a lower part.

Figure 5:
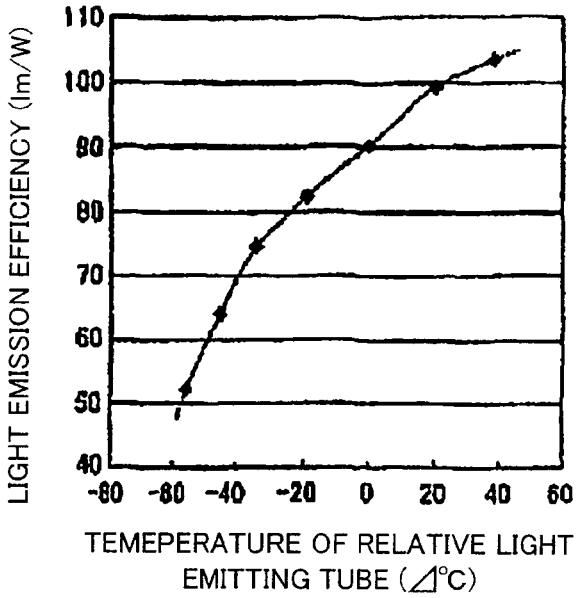
FIG. 5 is a view showing a relation between a temperature of the light emitting part and the light emission efficiency.

Further, explanation will be given for the relation between a variation of the temperature of the light emitting part and the light emission efficiency, with reference to FIG. 5. FIG. 5 shows the results of calculating the light emission efficiency [lm/W] when the temperature of the light emitting part is varied, with 920° C. as a reference, when the lamp is lighted at 35 W. As is clarified from this graph, a correlation is recognized, such that the light emission efficiency is reduced when the temperature of the light emitting part is reduced. It appears that this is because by reducing the temperature of the light emitting part, a partial pressure of the metal halide sealed in the light emitting part is also reduced.

As described above, it is found that the correlation is established between the temperature of the light emitting part and the light emission efficiency of the lamp. In other words, such knowledge suggests a point that the light emission efficiency can be controlled in a desired range, by appropriately adjusting the temperature of the light emitting part.

By focusing on a control of the temperature of the light emitting part, various parameters for designing the lamp having a sufficient light emission efficiency even under a low power condition, will be specifically described hereafter based on the present invention.

(1) Sealed Pressure of Xenon

Figure 6:
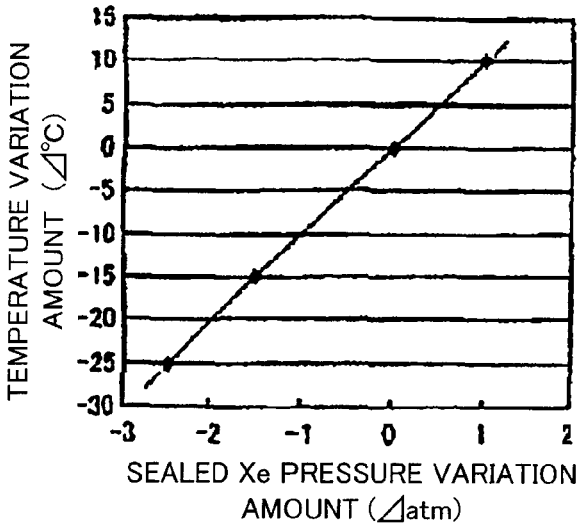
FIG. 6 is a view showing a relation between a pressure of xenon sealed in the light emitting part, and the temperature of the light emitting part.

FIG. 6 is a graph showing a variation amount (920° C. set as a reference) of the temperature of the light emitting part, when sealed pressure of xenon at room temperature is increased or decreased, with 13.5 atm as a reference. As is clarified from this graph, the relation between the sealed pressure of xenon and the variation amount of the temperature is set in approximately a proportional relationship, wherein the temperature of the light emitting part is increased as the xenon sealed pressure is increased. The xenon sealed pressure can be obtained by collecting xenon gas by destroying the light emitting part in the water, and measuring this amount.

Note that the xenon sealed pressure 13.5 atm used as a reference in FIG. 6, and the temperature of the light emitting part 920° C. are given as embodiments of the reference simply for the convenience of the explanation, and for example such specific physical amount is not necessarily suitable in relation to the present invention.

Namely, these values are arbitrarily defined reference values for the convenience of the explanation, including the reference values of other parameters described below, and restricted interpretation of the range of the present invention should be avoided by these reference values.

(2) Inner Diameter of the Light Emitting Part

Figure 7:
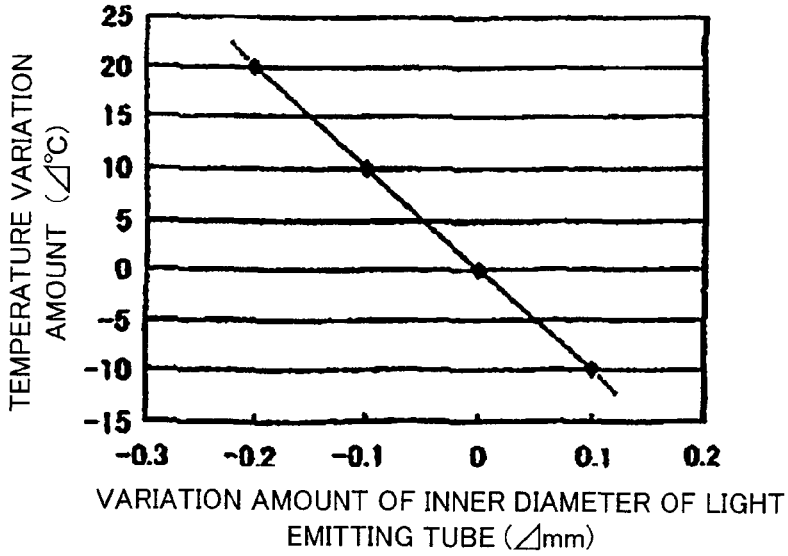
FIG. 7 is a view showing a relation between an inner diameter of the light emitting part of a part where a wall thickness of the light emitting part is maximum, and the temperature of the light emitting part.

FIG. 7 is a graph showing relative values based on the inner diameter of the light emitting part 2.5 mm taken on the horizontal axis, and showing relative values based on the temperature of the light emitting part 920° C. taken on the vertical axis. The "inner diameter of the light emitting part" in this specification means a diameter of a part where the wall thickness of the light emitting part 11 shown by designation mark "d" in FIG. 2, is maximum, unless particularly defined otherwise. Also, it is found from the graph shown in FIG. 7, that the temperature of the light emitting part is increased when the inner diameter of the light emitting part is decreased. This is because when the inner diameter of the light emitting part is decreased, a distance up to the arc generated between the electrodes is also decreased, thus remarkably increasing the temperature.

(3) Wall Thickness of the Light Emitting Part

Figure 8:
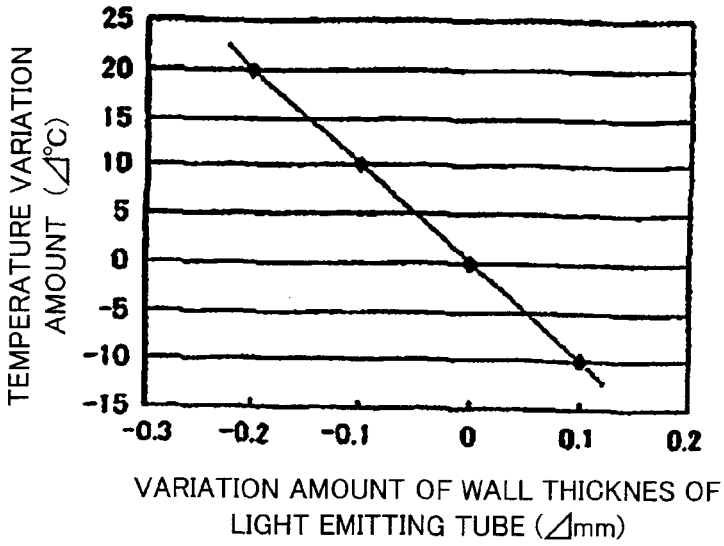
FIG. 8 is a view showing a relation between a wall thickness of a part where the wall thickness of the light emitting part is maximum, and the temperature of the light emitting part.

FIG. 8 is a graph showing relative values based on the wall thickness of the light emitting part 1.85 mm taken on the horizontal axis, and relative values based on the temperature of the light emitting part 920° C. taken on the vertical axis. The "wall thickness of the light emitting part" in this specification means a thickness of a part where the wall thickness of the light emitting part 11 shown by designation mark "t" in FIG. 2 is maximum, unless particularly defined otherwise. It is found from the graph shown in FIG. 8, that the temperature of the light emitting part is increased when the wall thickness of the light emitting part is decreased. This is because when the wall thickness of the light emitting part is decreased, heat is hardly diffused, thus causing a temperature increase to occur locally.

The wall thickness and the inner diameter of the light emitting part can be measured by using a publicly-known measuring device such as an X-ray diffraction device.

In order to examine characteristics of the lamp in which the temperature of the light emitting part is adjusted by varying the parameters of the aforementioned (1) to (3), a characteristic test was carried out, using a vehicle discharge lamp of the following specification as a basic design.

The light emitting part, with inner diameter d of 2.2 mm; outer diameter of 5.2 mm; wall thickness t of 1.5 mm; spherical body length b of 7.8 mm; thickness volume V of 89.5 $mm^3$, and volume of the discharge space of 20 $mm^3$, was used. The metal halide sealed in the discharge space was composed of a mixture of scandium iodide, sodium iodide, zinc iodide, and indium bromide, and total sealing amount was 0.2 mg. The ratio of the sealing amount of each metal halide was ScI3:NaI:ZnI2:InBr=1.00:1.50:0.40:0.01 by weight ratio. Then, 13.5 atm of Xenon was sealed as rare gas.

The electrode made of thoriated tungsten including 0.5 wt % of thorium oxide, with axial length of 7.5 mm, electrode diameter of 0.33 mm, and inter-electrode distance of 3.9 mm, was used. Further, the metal foil made of molybdenum with thickness of 20 μm, width of 1.5 mm, and tube axial direction length of 6.5 mm, was laser-welded to one end of the electrode, and was air-tightly sealed to a thin plate-like sealing part with thickness of 2.8 mm and width of 4.1 mm, so that a coil with pitch of 200% was wound on an about half of the region of an electrode axis positioned in the sealing part. The outer tube that surrounds the inner tube is formed into a cylindrical shape made of quartz glass doped with a material for blocking UV-light, with inner diameter of 7.0 mm and wall thickness of 1.0 mm. Argon of 0.05 atm was sealed in a closed space surrounded by the outer tube and the inner tube. Further, a distance between a part where the wall thickness of the light emitting part was maximum and the inner surface of the outer tube, was set to 0.95 mm for a portion to be an upper side when arranged in a horizontal direction, and set to 0.85 mm for a portion to be a lower side when arranged in a horizontal direction.

With this specification, about 2000 lm was obtained by an input at 25 W.

Further, regarding the parameters of (1) to (3), the following matters were clarified and therefore a range of numerical values to be tested and evaluated was limited.

First, when the sealed pressure of xenon of (1) is less than 10 atm at a room temperature, the light flux at the time of starting the lamp can not be obtained, and this is not suitable for the automobile headlight. Further, when the xenon sealed pressure exceeds 17 atm, excessive load is added to the sealing part, thus posing a problem like a failure in lighting the lamp due to leak of the current. Therefore, in this test, the xenon sealed pressure was adjusted step by step in a range of 10 to 17 atm.

When the inner diameter of the light emitting part of (2) is set to be smaller than 2.0 mm, a light shielding action of the sealed metal halide is remarkably exhibited, thus reducing the light emission efficiency. Further, when the inner diameter is set to be larger than 2.5 mm, there is a possibility that the light emitting part is brought into contact with the outer tube, depending on manufacturing variation, and also depending on the wall thickness of the light emitting part, when a specification is similar to the specification of a conventional lamp that is lighted at 35 W, and therefore a manufacturing yield is deteriorated. Accordingly, the test was carried out, with the inner diameter of the light emitting part adjusted in a range of 2.0 to 2.5 mm.

When the wall thickness of the light emitting part of (3) is set to be smaller than 1.30 mm, there is a possibility that the light emitting part is remarkably expanded. Further, when the wall thickness is set to be larger than 1.85 mm, there is a possibility that the outer tube and the light emitting part are brought into contact with each other, although depending on the inner diameter of the light emitting part, and this is not preferable. Accordingly, in this test, the wall thickness of the light emitting part was adjusted in a range of 1.30 to 1.85 mm.

Results of the test carried out under the aforementioned conditions and characteristic evaluation are shown in FIG. 9. "○" in the item of "judgment" means the lamp showing excellent characteristic, and "x" indicates a defective lamp. Further, "Δ" indicates a combination of them, wherein total light flux is reduced because input power is reduced, although light emission efficiency is obtained.

It is found that an excellent result can be obtained regarding startup characteristic and service life characteristic, by controlling the temperature of the light emitting part within ±40° C., compared with the present lamp that is lighted at 35 W. Namely, sufficient light emission efficiency can not be obtained when the relative temperature of the light emitting part is lower than −40° C. compared with the lamp lighted at 35 W, and such a lamp is outside a practical range. Further, when the relative temperature exceeds 40° C., the light emitting part becomes clouded, thus involving a problem that usable total light flux is reduced, and shortening a service life of the lamp. It was found from this result, that excellent characteristic was exhibited by the discharge lamp if satisfying the following formula 1.

$$-40 \leqq (a-35)\times 5.5+(x-13.5)\times 10+(1.85-t)\times 100+(2.5-d)\times 100 \leqq 40 \quad \text{(Formula 1)}$$

wherein a: power [W] supplied in a stable lighting time, satisfying $18 \leqq a \leqq 30$ x: pressure of xenon sealed in the discharge space [atm]

t: thickness of a part where the wall thickness of the light emitting part is maximum [mm]

d: inner diameter of a part where the wall thickness of the light emitting part is maximum [mm]

The formula 1 is obtained by mathematizing the following mater. Namely, excellent results are shown if the temperature of the light emitting part is in a range of ±40° C. compared with a conventional one. Specifically, a numerical value of a left side corresponds to −40° C., being a lower limit value of an allowable temperature, and a numerical value of a right side corresponds to 40° C., being an upper limit value thereof. Then, the item of a middle side [(a−35)×5.5] corresponds to the variation amount of the temperature of the light emitting part, which is varied depending on a power of the lamp, and the item of [(x−13.5)×10] corresponds to the variation amount of the temperature of the light emitting part, which is varied depending on the sealed pressure of xenon. Also, the item of [(1.85−t)×100] corresponds to the variation amount of the temperature of the light emitting part, which is varied depending on the wall thickness of the light emitting part, and the item of [(2.5−d)×100] corresponds to the variation amount of the temperature of the light emitting part, which is varied depending on the inner diameter of the light emitting part.

By employing this inequality based on the present invention, the discharge lamp having sufficient startup characteristic and service life characteristic can be designed even at a lower power of 18 to 30 W.

Application of the present invention will be described next, in a case that further detailed conditions are set. Explanation is given above, such that the aforementioned formula 1 can be applied to the lamp with a power in a range of 18 to 30 W, which is evaluated to be a lower power. However, even if the light emission efficiency can be improved to be equal to or more than the power of the lamp, low power of the lamp means that the total light flux is also reduced by a portion of the low power ((total light flux)=(lamp power)×(light emission efficiency)). Accordingly, the light emission efficiency required for achieving practical total light flux of 1800 to 2200 lm is different between lamp powers 18 W and 30 W. For example, in order to obtain the light flux of 2000 lm at an input power of 20 W for example, efficiency of 100 lm/W is required. This is because efficiency higher than the efficiency of the present lamp of 35 W (911 m/W) is required, and in other words, higher temperature of the light emitting part is necessary.

Accordingly, when the lamp power is 18 to 22 W, an optimal relation of each parameter can be expressed by the following formula 2.

$$20 \leqq (a-35)\times 5.5+(x-13.5)\times 10+(1.85-t)\times 100+(2.5-d)\times 100 \leqq 40 \quad \text{(Formula 2)}$$

wherein a: Power supplied in a stable lighting time, satisfying 18≦a≦22 [W]

x: Pressure of rare gas sealed in the discharge space [atm]

t: Thickness of a part where the wall thickness of the light emitting part is maximum [mm]

d: Inner diameter of a part where the wall thickness of the light emitting part is maximum [mm]

When the lamp power is 22 to 26 W, the light emission efficiency needs to be controlled to the same degree of the conventional lamp of 35 W. Therefore, the relation of each parameter can be expressed by the following formula 3.

$$-20 \leqq (a-35)\times 5.5+(x-13.5)\times 10+(1.85--t)\times 100+(2.5-d)\times 100 \leqq 20 \quad \text{(Formula 3)}$$

wherein a: Power supplied in a stable lighting time, satisfying 22<a≦26 [W]

x: Pressure of rare gas sealed in the discharge space [atm]

t: Thickness of a part where the wall thickness of the light emitting part is maximum [mm]

d: Inner diameter of a part where the wall thickness of the light emitting part is maximum [mm]

when the lamp power is 26 to 30 W, the light emission efficiency needs to be controlled to about 70 lm/W, and therefore the relation of each parameter can be expressed by formula 4.

$$-40 \leqq (a-35)\times 5.5+(x-13.5)\times 10+(1.85--t)\times 100+(2.5-d)\times 100 \leqq -20 \quad \text{(Formula 4)}$$

wherein a: Power supplied in a stable lighting time, satisfying 26<a≦30 [W]

x: Pressure of rare gas sealed in the discharge space [atm]

t: Thickness of a part where the wall thickness of the light emitting part is maximum [mm]

d: Inner diameter of a part where the wall thickness of the light emitting part is maximum [mm]

As described above, one of the major objects of the present invention is to obtain the total light flux of 2000±200 lm at an input power of 18 to 30 W. However, it should be understood that such a numerical value range of the input power and the total light flux also includes a range determined depending on a manufacturing variation and a use state, as an equivalent.

In addition, in the discharge lamp that is lighted at a power lower than a conventional power, the thickness volume V of the light emitting part 11 is preferably set in a suitable range, to keep the temperature of the light emitting part suitably. This is because the temperature of a light emitting tube is most influenced by the inner diameter d of a part where the wall thickness is maximum, and the thickness t, and the temperature of the light emitting part is influenced by the spherical body length b and shapes of the light emitting part 11 and the discharge space 111. Then, it is found that the thickness volume V of the light emitting part 11 is preferably set in a suitable range similarly to the wall thickness t, the inner diameter d, and the spherical body length b. For example, 124.5 $mm^3$, being a conventional thickness volume V of the light emitting part 11, and 89.5 $mm^3$, being the thickness volume V of the embodiment, are greatly different characteristics. As a result of the test by the inventors of the present invention, it is found that preferably the wall thickness t is set to 1.30 to 1.85 mm, the inner diameter d is set to 2.0 to 2.5 mm, the spherical body length b is set to 7.5 mm to 8.5 mm, and the thickness volume V of the light emitting part 11 is set to 50 $mm^3$ to 100 $mm^3$, and preferably set to 60 mm3 to 90 $mm^3$. Note that the thickness volume V of the light emitting part 11 can be calculated by cutting a boundary between the light emitting part 11 and the sealing part 12, and measuring a weight of the remained light emitting part 11, and thereafter dividing the measured weight by a relative weight of a material of the light emitting part 11 (for example, the relative weight of the quartz glass is 2.65 $g/cm^3$).

Further, the electrode 32 is preferably made of thoriated tungsten. This is because the electrode not including thorium oxide, has a high workfunction, thus making it difficult to increase the efficiency. The content is preferably 0.1 wt % or more and 0.5 wt % or less, when suppressing effect of flickering and efficiency are taken into consideration.

Further, the gas sealed into the closed space 51 is also preferably taken into consideration. Namely, the light emission efficiency and a light flux maintenance factor in FIG. 9 are influenced by the gas sealed into the closed space 51, depending on a heat conductivity of the gas of the closed space 51. When a test was carried out by the inventors of the present invention, it was found that in the discharge lamp of low power, if a single gas is used, generally it is easier to keep the temperature of the light emitting part by argon (λ=0.0177 W/m·K) than sealed nitrogen which is generally sealed in a case of the conventional lamp of 35 W. In a case of a mixed gas mixing argon, neon (λ=0.0493 W/m·K), xenon (λ=0.0057 W/m·K), and nitrogen (λ=0.0260 W/m·K), etc., heat conductivity λ is preferably 0.010 to 0.030 W/m·K, and further preferably 0.015 to 0.021 W/m·K. Note that the heat conductivity λ of the mixed gas is obtained in such a manner that the heat conductivity specific to gas is multiplied by the sealing ratio for each gas, and multiplied values thus obtained are totaled.

Further, the temperature of the light emitting part is also influenced by a distance D between a part where the outer diameter of the light emitting part 11 is maximum and an inner surface of the outer tube 5, similarly to the heat conductivity λ of the gas. According to the test by the inventors of the present invention, it was found that the distance D was longer than about 0.3 mm, being a general distance, and was preferably 0.5 to 1.0 mm, and further preferably 0.65 to 0.85 mm. Note that as shown in FIG. 2, the light emitting part 11 is offset downward with respect to the tube axis of the outer tube 5 in a horizontal state, and a distance in an upper part of the light emitting part may be set to be larger by about 1 mm than a distance in a lower part thereof.

(Second Embodiment)

FIG. 10 is a view for describing a vehicle discharge lamp according to a second embodiment of the present invention. Regarding each part of the embodiment, the same signs and numerals are assigned to a part same as each part of the vehicle discharge lamp of the first embodiment, and explanation thereof is omitted.

In this embodiment, a position for mounting the metal band 71 is set at the light emitting part 11 side, rather than the position shown in the first embodiment. Thus, a total length of the discharge lamp can be shortened, and therefore a compact lamp can be realized. Note that in this embodiment, in accordance with a change of a position of the metal band 71, a position of a heat sealing part is changed to a tip end side of the lamp closer thereto than conventional, without changing a length between the heat sealing part on the socket 5 side of the inner tube 1 and the outer tube 5. Therefore, the lamp can be held without changing a structure of the socket 5.

Further, in this lamp, the distance c between the metal foil 31 and the metal band 71, namely, a length in the tube axial direction from an end portion of the metal band 71 on the tip end side of the lamp, to the socket 5 side end portion of the metal foil 31 is shortened. Therefore, a generation rate of the dielectric barrier discharge is improved to assist start of the lamp at startup, and an advantage of an excellent startup performance can be obtained.

Figure 11:
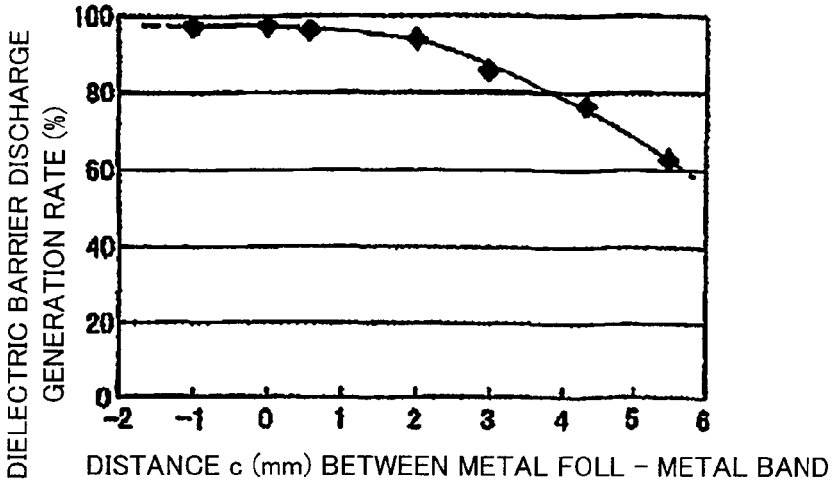
FIG. 11 is a view for describing a distance c between a metal foil and a metal band, and a generation rate of a dielectric barrier discharge.

FIG. 11 is a view showing results of testing the generation rate of the dielectric barrier discharge, regarding 50 lamps respectively, with distance c varied between the metal foil and the metal band. As is clarified from this figure, the generation rate of the dielectric barrier discharge is higher as the distance c becomes shorter, and for example, the dielectric barrier discharge is tremendously easily generated at distance c=0.5 mm of this embodiment, compared with a conventional case of 5.5 mm. The reason can be considered as follows. Namely, the distance for generating the dielectric barrier discharge is shortened when the distance c is closed to 0. According to the results of the test, when the distance c is set to 2 mm or less, and particularly the distance c is set to 0 mm or less, namely, when at least a part of the metal foil 31 and a part of the metal band 71 are overlapped on each other, a high effect can be expected.

Such an effect of increasing the generation rate of the dielectric barrier discharge at startup, can be similarly obtained even by a metal member such as a metal plate or a metal film having conductivity. However, it is most efficient that the metal band 71 for connecting a lamp portion and a socket portion has a function of assisting the generation of the dielectric barrier discharge, as shown in this embodiment.

(Third Embodiment)

Figure 12:
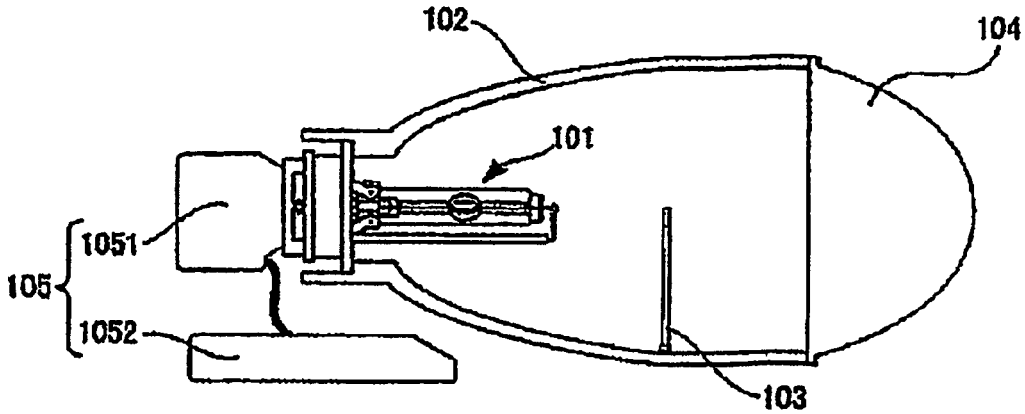
FIG. 12 is a view for describing a discharge lamp device according to a third embodiment of the present invention.
Figures 13, 14:
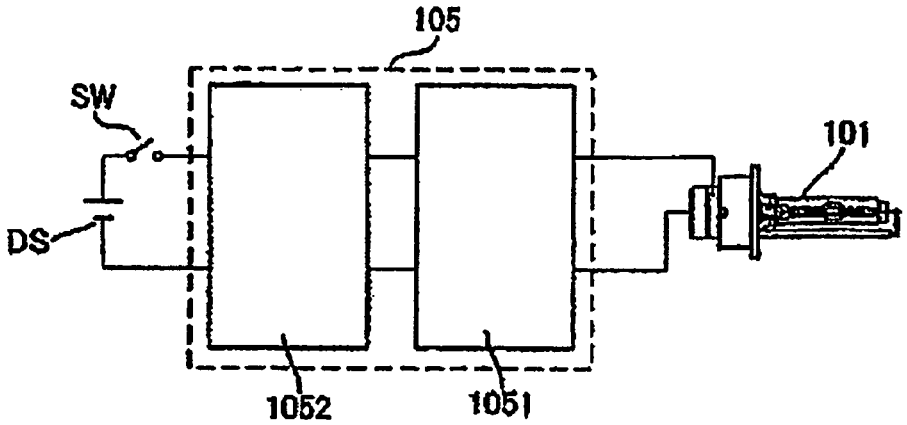
FIG. 13 is a view for explaining a circuit structure of the discharge lamp device.
FIG. 14 is a view for describing presence or absence of flickering when a current slope of a zero cross current is varied.

FIG. 12 is a view for describing a vehicle discharge lamp device according to a third embodiment of the present invention, and FIG. 13 is a circuit view.

The vehicle discharge lamp device is constituted of a vehicle discharge lamp 101, a reflector 102, a light shielding control plate 103, a lens 104, and a lighting circuit 105, and is used, with a tube axis set in approximately a horizontal state.

The vehicle discharge lamp 101 is the lamp described in the first embodiment, etc.

The reflector 102 is a parabolic shaped metal member provided for reflecting lights frontward, the lights being generated by the vehicle discharge lamp 101. An opening is formed in the vicinity of its center, and a front end portion of the socket 6 of the vehicle discharge lamp 101 is fixed to the opening end, so that the light emitting part 11 is positioned inside of the reflector 102.

The light shielding control plate 103 is the metal member provided for forming a light distribution called a outline. The light shielding control plate 103 is a movable type, and switch to a high beam from a low beam is enabled by making the light shielding control plate 103 inclined frontward to a bottom side.

The lens 104 is a convex lens provided for forming a desired light distribution by collecting the lights reflected by the reflector 102, and is disposed in the opening on the tip end side of the reflector 102.

The lighting circuit 105 is a circuit for starting and lighting the vehicle discharge lamp 101, and as shown in FIG. 13, includes an igniter circuit 1051 and a ballast circuit 1052 wherein DC power DS such as a battery and switch SW are connected to an input side, and the vehicle discharge lamp 101 is connected to an output side.

The igniter circuit 1051 is a circuit for starting the vehicle discharge lamp 101 by causing dielectric breakdown to occur between a pair of electrodes 32, by generating a high-voltage pulse of about 30 kV and applying it to the lamp. The igniter circuit 1051 is also constituted of a transformer, a capacitor, a gap, and a resistor, etc.

The ballast circuit 1052 is a circuit for keeping the lighting of the vehicle discharge lamp 101 started by the igniter circuit 1051. The ballast circuit 1052 is also constituted of a DC/DC converter circuit, DC/AC converter circuit, a current/voltage detecting circuit, and a control circuit, etc.

As is described in patent document 1, a discharge lamp with a lower power has a problem that flickering occurs due to reduction of a current value, and as a result of flickering, fizzle-out is easily generated. The patent document 1 provides the invention of suppressing the problem of flickering by more thinly designing an electrode than conventional. An effect of suppressing the flickering in a steady time can be expected if this invention is employed. However, as a result of examination by the inventors of the present invention, it is found that in a lamp into which, for example, 2.0 A of current which is more than three times the current of a steady time, is input at startup for 5 or more to quicken rise of light flux, the temperature is excessively high at a startup time in a case of a thin electrode, and such a lamp has a short service life. Namely, in the means of the patent document 1, it is difficult to realize the vehicle discharge lamp with lower power, a long service life, and a quick rise of light flux, wherein flickering is hardly generated.

Therefore, when the means for suppressing the flickering is examined by using other device, it is found that a low power discharge lamp hardly allowing flickering to occur can be realized by suitably setting a current slope of a zero cross current in a steady time set by the ballast circuit 1052, even under a condition that a current cross-sectional area is 6 to 15 $A/mm^2$ (a diameter of the electrode corresponds to about 0.25 to 0.35 mm. Note that the diameter in a case of the electrode having partially different size, is a diameter of a portion occupying a major part of the electrode), capable of withstanding a large current if such a current is input.

Figure 15:
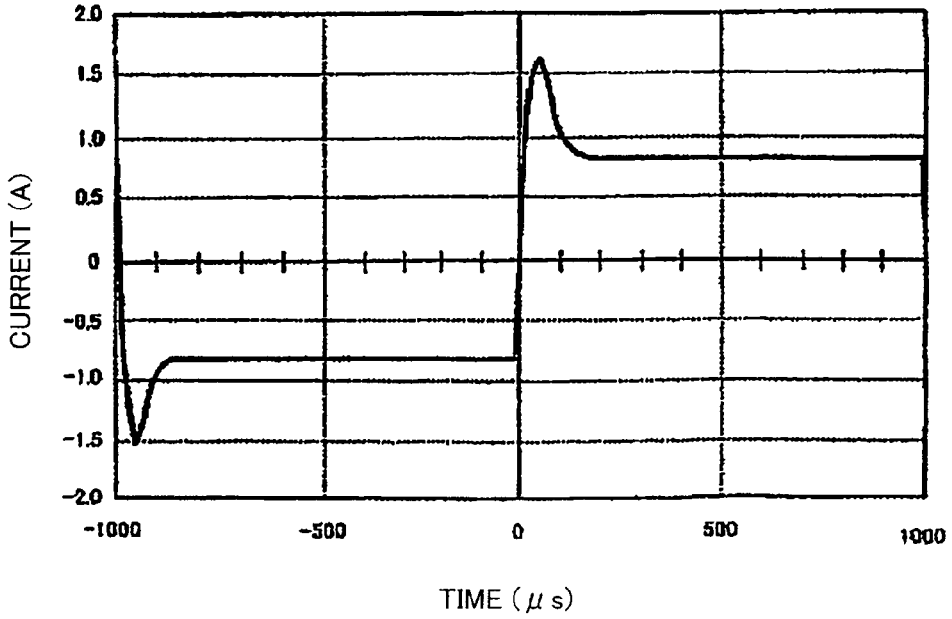
FIG. 15 is a current waveform chart for describing the zero cross current.
Figure 16:
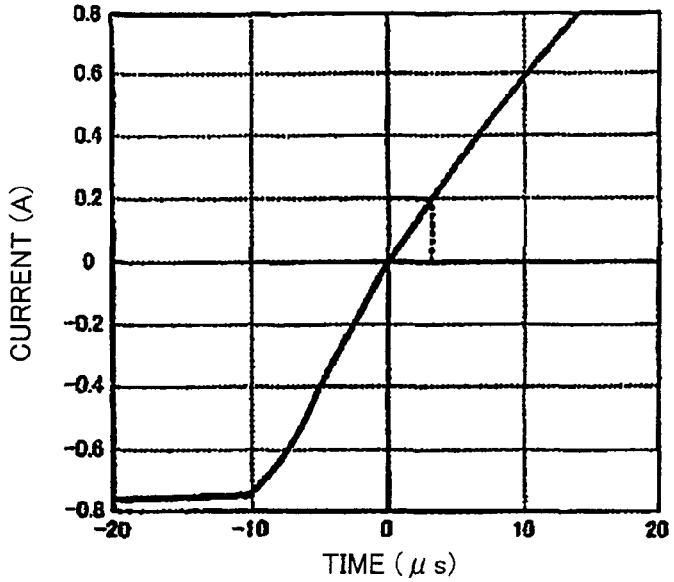
FIG. 16 is an expanded view in the vicinity of the zero cross of FIG. 15.

FIG. 14 is a view for describing presence/absence of the flickering when the current slope of the zero cross current is varied. Wherein, the "current slope of the zero cross current" means the current slope when the polarity of the current in a steady time is changed, namely, the current slope after a current value crosses the 0 A horizontal axis. The current slope is expressed by values in a period from a point where the polarity is inverted with great influence on suppression of the flickering, up to 0.2 A. For example, in FIG. 16, which is an expanded view of the vicinity of the zero cross of FIG. 15, the current slope of the zero cross current is 0.062 A/μs. Further, in this test, the power was set to 25 W, and the flickering was judged by measuring with an illuminometer a brightness of 60 to 720 seconds after lighting, and it was judged to be x when there was a variation of the brightness of 3% or more, with respect to the brightness of 0.5 seconds before.

As a result, it is found that there is a relation between the current slope of the zero cross current and the flickering, and although the flickering is not generated at 0.05 A/μs or more, the flickering is generated when the current slope of the zero cross current is 0.03 A/μs. It can be considered that this is because when the current slope of the zero cross current is 0.03 A/μs or less, the current does not flow to the electrode so much immediately after inverting the polarity, thus reducing the temperature of the electrode, resulting in unstable starting point of arc. Meanwhile, when the current slope of the zero cross current is 0.05 A/μs or more, the temperature of the electrode is not decreased even if the polarity is inverted, thus making it possible to keep a high temperature, and hardly allowing the flickering to occur. Accordingly, the current slope of the zero cross current is preferably set to 0.05 A/μs or more. Note that as the current slope of the zero cross current is larger, there is an effective advantage against the flickering. However, the current slope of the zero cross current is adjusted, mainly by reducing the number of turns of a secondary winding of a transformer. Therefore, practically, the current slope of the zero cross current is preferably set to 0.60 A/μs or less.

Figures 17, 18:
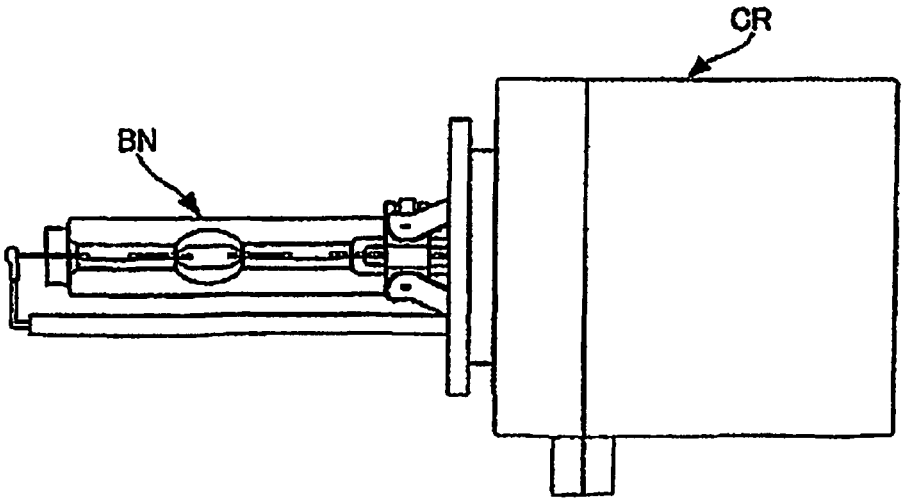
FIG. 17 is a view for describing presence or absence of the flickering when a light frequency of the current in a stable time is varied.
FIG. 18 is a view for describing a lighting circuit combined type discharge lamp device according to a fourth embodiment of the present invention.

In addition, it is further effective to set a lighting frequency in a suitable range. Specifically, as shown in FIG. 17, when the frequency is 500 Hz or less, the temperature of the electrode is kept to be high, and therefore the flickering is suppressed. However, when the frequency is 100 Hz or less, the temperature of the electrode becomes unnecessarily too high, resulting in a short service life. Therefore, the frequency is preferably set to 20 to 500 Hz.

(Fourth Embodiment)

Figure 19:
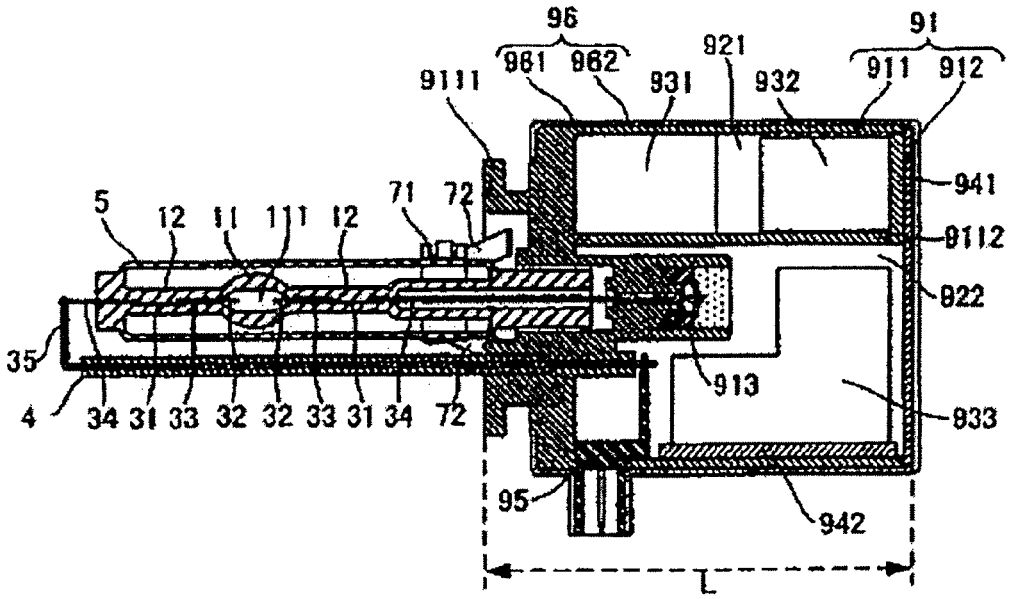
FIG. 19 is a sectional view of the lighting circuit combined type discharge lamp device of FIG. 18.

FIG. 18 is a view for describing a lighting circuit combined type vehicle discharge lamp device according to a fourth embodiment of the present invention, and FIG. 19 is a sectional view of FIG. 18.

The aforementioned embodiment is a type that a lamp portion and a circuit portion are handled as separate bodies. However, this embodiment is a type that the lamp portion and the circuit portion are integrally formed. Namely, a burner BN of the lamp and a circuit part CR including the igniter circuit and the ballast circuit are integrally formed.

The circuit part CR is a device for starting and stably lighting the burner BN, and includes a case 91 made of PPS resin for example, as a housing. The case 91 is constituted of a main body part 911 and a lid member 912 which are engaged with each other.

The main body part 911 has a socket part 9111 on its front end side, and the burner BN is held by the socket part 9111 as follows. Namely, similarly to the first embodiment, the metal band 71 is mounted on the outer peripheral surface of the outer tube 5, and the metal band 71 is grasped by the metal ligulas 72 which are protruded from the socket part 9111.

Further, space is formed inside the main body part 911. The space is further divided into an upper space 921 and a lower space 922, by a space dividing wall 9112 formed inside the main body part 911 along a tube axial direction. Note that although the space dividing wall 9112 is integrally formed with the main body part 911 of the case 91 in this embodiment, a separately formed wall may be formed by inserting it into the main body part 911 from a rear side, or may be formed, with a container used as a wall, in which a transformer 931 as will be described later is housed.

The transformer 931 is disposed on the front end side of the upper space 921 of the case 91. The transformer 931 is formed by winding a primary winding and the secondary winding on an elongated rod-like iron core, and is used in a state of being housed in the container filled with an insulating material such as epoxy, for securing insulation properties. However, the shape of the transformer 931 is not limited to a rod-like shape, and of course there is no problem in forming it into a box shape or a donut shape. A high-voltage terminal 913 is provided to the transformer 931, and the high-voltage terminal 913 is connected to a lead 34 led out into an internal space of the main body part 911. This connection part is a part into which a high-voltage pulse is input at startup, and therefore as shown in FIG. 19, preferably the space is potted with an insulating material, or a resin wall is newly formed, for securing the insulation properties.

Further, a first circuit element group 932 is arranged on a rear end side of the upper space 921, for generating the high-voltage pulse by the transformer 931 to start the burner BN. The first circuit element group 932 is constituted of a capacitor, a gap, and a resistor, etc., which are implanted on a mounting substrate 941 with wiring incorporated inside thereof or on the surface thereof. Note that the "the members are arranged on the front end side (rear end side) of the case 91" means a state that a major part of the members, for example, 80% or more of the members are arranged on the front end side (rear end side) of L/2, when the tube axial length of the case is set to L.

A connector 95 is disposed on the front end side of the lower space 922 of the case 91, so as to partially protrude from the case 91. The connector 95 is electrically connected to a support wire 35 led out to the internal space of the main body part 911. Note that the connector 95 needs not to be formed by a separate member, and may be formed integrally with the case 91. Further, the connector 95 may be formed on the mounting substrate or as apart of the mounting substrate.

Further, a second circuit element group 933 for supplying a rated power to the burner BN, is arranged on the rear end side of the lower space 922. The second circuit element group 933 is constituted of a capacitor, a resistor, a switching element, a diode, and a microcomputer, etc., which are implanted on a mounting substrate 942 with wiring incorporated therein. Note that the capacitor in the second circuit element group 933 is particularly disposed on the rear end side of the lower space 922.

A shield case 96 for shielding an electromagnetic noise, is provided around the case 91 including these circuit elements, etc. The shield case 96 is constituted of a case 961 and a case 962, which are integrally engaged with each other. For example, aluminum can be used as the shield case 96.

Figure 20:
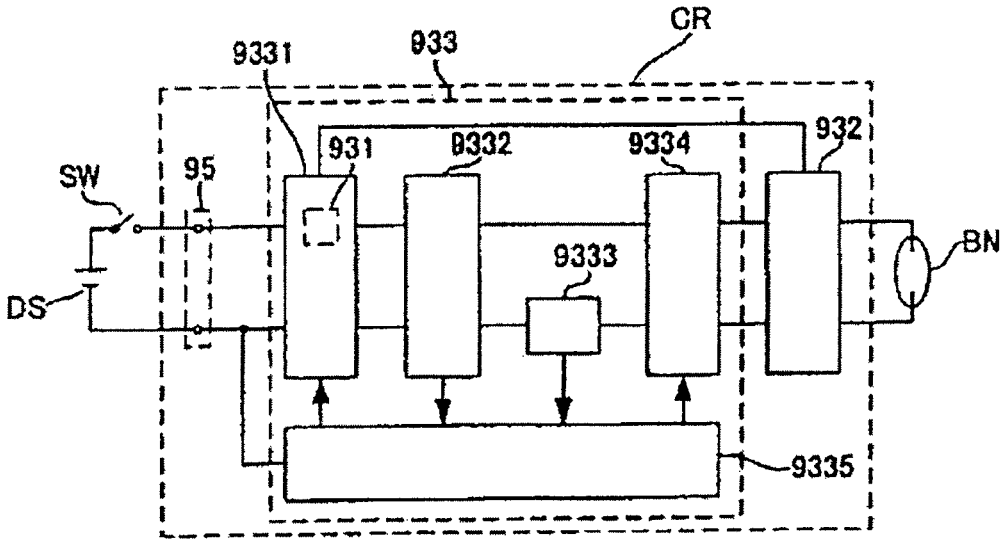
FIG. 20 is a view for describing a circuit structure of the lighting circuit combined type discharge lamp device.

A circuit structure of the discharge lamp device of this embodiment is shown in FIG. 20. The discharge lamp device is constituted of a circuit part CR including the connector 95, the second circuit element group 933, and the first circuit element group 932, and the burner BN, wherein the connector 95 portion is connected to the DC power supply DS such as a battery, via the switch SW.

The second circuit element group 933 is constituted of a DC/DC converter circuit 9331, a voltage detecting circuit 9332, a current detecting circuit 9333, a DC/AC inverter circuit 9334, and a control circuit 9335. The DC/DC converter circuit 9331 is a boost chopper circuit to boost and output a DC voltage of the DC power supply DS. A step-up transformer is disposed in this DC/DC converter circuit 9331, and the step-up transformer also functions as a transformer 931 that generates the high-voltage pulse for starting the burner BN, together with the first circuit element group 932. The voltage detecting circuit 9332 and the current detecting circuit 9333 are respectively the circuits for detecting an output voltage and an output current of the DC/DC converter circuit 9331. The DC/AC inverter circuit 9334 is a bridge circuit for converting DC to AC, and outputting the converted current. The control circuit 9335 is a circuit for controlling the DC/DC converter circuit 9331 and the DC/AC inverter circuit 9334 so that a prescribe rated power is input to the burner BN based on a detection result of a voltage value and a current value detected by the voltage detecting circuit 9332 and the current detecting circuit 9333.

The first circuit element group 932 is a circuit for generating the high-voltage pulse required for starting the lamp and starting the burner BN, in cooperation with the transformer 931 which is formed as a part of the aforementioned boost transformer.

With this circuit structure, in the circuit part CR, the high-voltage pulse of around 30 kV is generated for starting the burner BN, and immediately after starting the burnet BN, power of 65 W to 75 W which is more than twice the power of a steady time is generated, and power of 25 to 35 W is generated in a steady time, and the power thus generated is supplied to the burner BN.

Then, the following test was carried out. Namely, the lighting circuit combined type vehicle discharge lamp device of this embodiment was attached to the reflector as shown in FIG. 12, and the lamp was lighted while vibrating the whole body of the device. As a result, it was confirmed that there was less positional fluctuation of the discharge arc formed between the pair of electrodes 32 while being lighted even if the whole body of the device was vibrated, and failure in light distribution could be avoided. This is because a weight balance in the tube axial direction of the discharge lamp is improved by disposing the transformer 931 heavy in weight on the front end side and on the upper space 921 side of the case 91, in the socket part 9111 that functions as a fulcrum in a state of the vehicle discharge lamp device. Thus, an effect of generating less positional fluctuation of the discharge arc even if the device is vibrated, is meaningful in the discharge lamp not sealing mercury that easily allows the light distribution to be changed even in a case of a slight fluctuation of the discharge arc caused by thinning of an arc.

Further, in order to further improve the weight balance and reduce a weight bias in upper and lower parts of the discharge lamp device, the connector 95 with a harness mounted thereon, is disposed on the front end side and the lower space 922 side. This would contribute to suppressing the failure in light distribution. To summarize, the lighting circuit combined type discharge lamp device including the igniter circuit and the ballast circuit involves a problem that the weight balance of the discharge lamp device is poor, because the weight on the circuit side is increased, and the position of the arc formed between electrodes while being lighted is easily changed by vibration, etc. However, such a problem is solved by this embodiment.

Further, in the discharge lamp device of this embodiment, the first circuit element group 932 and the second circuit element group 933 are arranged on the rear end side of the case 91 which is long in the tube axial direction. Therefore, there is an advantage that the service life of the circuit element is prolonged. This is because increase of the temperature of the circuit element can be suppressed by keeping the distance between the circuit elements, and the light emitting part 11 and the transformer 931 whose temperatures are increased while being lighted. Note that when the mounting substrate 942 is disposed along the tube axial direction as shown in this embodiment, it is most suitable to dispose the capacitor of the first circuit element group 932 which is large in size and sensitive to heat, particularly on the rear end side of the case 91 (for example, the rear end side of L/4). Incidentally, the first circuit element group 932 and the second circuit element group 933 are relatively light in weight, and therefore even when they are disposed on the rear end side of the case 91, there is almost no influence on the weight balance.

Accordingly, according to this embodiment, the weight balance in the tube axial direction is improved by constituting the circuit part CR by the case 91, the transformer 931, the first circuit element group 932 for generating the high-voltage pulse using the transformer 931 and starting the burner BN, the second circuit element group 933 for supplying the rated power to the burner BN, and the connector 95 disposed in such a manner as protruding from the case 91, and by disposing the transformer 931 on the front end side in the case 91. Therefore, even if the vibration is added to the discharge lamp device, the positional fluctuation of the discharge arc formed between a pair of electrodes 22 while being lighted, can be suppressed, and the failure in the light distribution can be suppressed. Note that the shape of the case 91 is not limited to a long shape in the tube axial direction. Further, the transformer 931 is not limited to one, and there may be a plurality of transformers. In this case, the transformer for generating the high-voltage pulse for starting the burner BN may be disposed at least on the front end side of the case 91.

The weight balance in the tube axial direction is improved, and the upper and lower weight bias can be reduced, and also failure in the light distribution can be suppressed by forming the space dividing wall 9112 for dividing the internal space into the upper space 921 and the lower space 922 in the case 91, and disposing the transformer 931 on the front end side and on the upper space 921 side in the case 91, and disposing the connector 95 on the front end side and on the lower space 922 side in case 91.

Further, the service life can be prolonged because the distance between the heat source and the circuit elements can be kept, by disposing the first circuit element group 932 and the second circuit element group 933 on the rear end side in the case 91.

Further, by disposing the capacitor included in the second circuit element group 933 on the rear end side and on the lower space 922 side in the case 91, the distance between the light emitting part 11 and the transformer 931 becomes longer. Therefore, failure of the capacitor, which is sensitive to heat, can be prevented.

(Fifth Embodiment)

Figure 21:
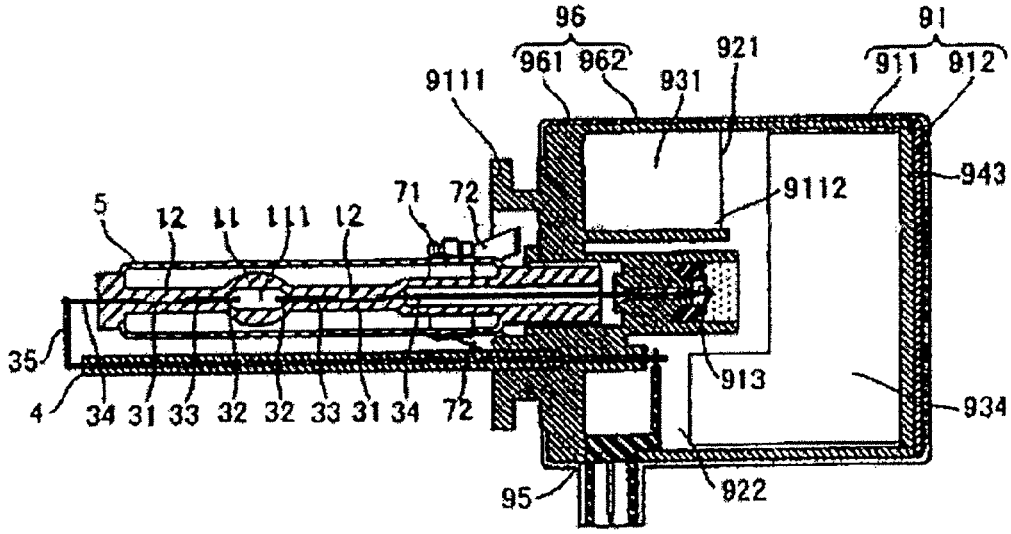
FIG. 21 is a view for describing the lighting circuit combined type discharge lamp device according to a fifth embodiment of the present invention.

FIG. 21 is a sectional view of alighting circuit combined type vehicle discharge lamp device according to a fifth embodiment of the present invention.

In this embodiment, the space dividing wall 9112 is extended up to approximately half of the case 91 in the longitudinal direction, and the mounting substrate 943 on which the circuit element group 934 is mounted, is disposed on the rear end side of the case 91 approximately vertical to the tube axis, wherein the circuit element group 934 is constituted of the first circuit element group and the second circuit element group. With this structure, a layout of the wiring is more simplified than that of the first embodiment, and therefore the circuit element group 934 can be easily assembled into the case 91. Note that when the mounting substrate 943 is disposed vertically to the tube axis like this embodiment, it is best suitable to dispose the capacitor on the rear end side of the case 91 and on the lower space 922 side of the case 91, to reduce an influence of heat. Further, in this embodiment, the circuit elements may be partially shared by the igniter and the ballast, to thereby reduce the number of circuit elements.

(Sixth Embodiment)

Figure 22:
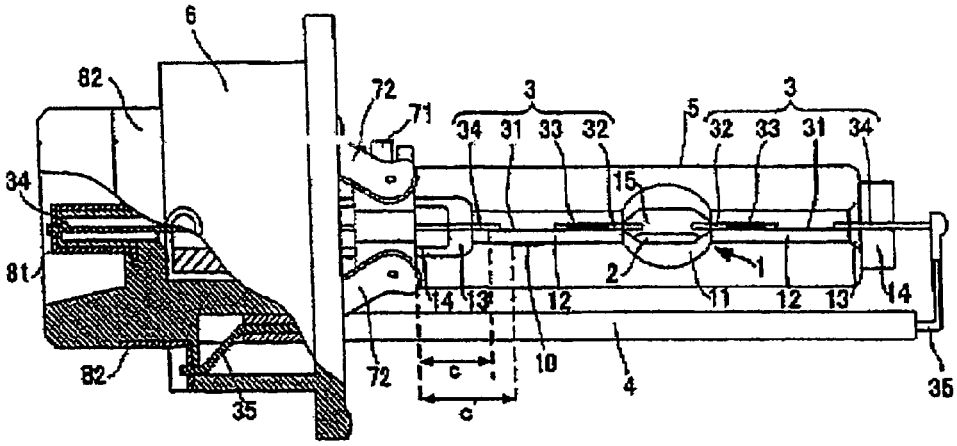
FIG. 22 is a view for describing a discharge lamp according to a sixth embodiment of the present invention.

FIG. 22 is an overall view of a vehicle discharge lamp according to a sixth embodiment of the present invention.

In this embodiment, a conductive coating film 10 is formed on a surface of a sealing part 12 installed on the high-voltage side of the vehicle discharge lamp as described in the first and second embodiments. With this structure, startup performance can be improved as will be described later in detail.

The conductive coating film 10 is preferably formed of a material having conductivity and hardly reacting with oxygen, etc., and for example gold, oxide of indium, oxide of tin, oxide of zinc, ITO as oxide of indium and tin, AZO obtained by doping zinc oxide with aluminum oxide, GZO obtained by doping zinc oxide with gallium oxide, or the like, and a material obtained by doping them with fluorine, gallium, and antimony, etc., can be used. Further, the material is preferably selected so that the resistance of a coating film portion is about 106 Ω/cm or less, and preferably 50 to 100 kΩ (a resistance value is a value obtained by measuring the surface of a film having thickness of 150 nm, by a tester with inter-terminals set to 1.5 mm.). The resistance value of this part depends on the thickness of the formed coating film, and although not determined only by selecting the material, the resistance value is an effective index to be controlled in the aforementioned value, for easily causing the barrier discharge to occur. In short, the material and a combination thereof used based on the concept of the present invention, can be suitably determined according to each element suggested in this specification.

Further, according to a conventional art (International Patent Publication No. 2007-093525), the conductive coating film 10 is formed in light emitting part and in the vicinity of the light emitting part, thus involving a problem that there is an adverse influence on light emitting characteristics such as total light flux unless a transparent material is selected as the material constituting the coating film 10. However, in the discharge lamp according to this embodiment, the conductive coating film 10 is formed only around the metal foil 31 which does not emit light in a steady time, and therefore the material needs not to be a transparent material. Further, the conductive coating film 10 is formed at a distance sufficiently far from the light emitting part 11, and therefore there is less influence caused by heat, etc. Namely, the discharge lamp of this embodiment is also excellent in a point that the material can be relatively freely selected based on a condition that the startup characteristics can be improved.

An action of the discharge lamp of the present invention will be described next.

When a high voltage is applied to the lamp, a lot of electrons are discharged to the closed space 51 from the conductive coating film 10 formed in the sealing part 12, to thereby electrify the closed space 51. At this time, a potential difference is generated in the conductive coating film 10 and the closed space 51, thus causing discharge to occur at a low voltage. Owing to such a discharge, polarization and a photoelectric effect occur inside/outside a surface of the inner tube 1, resulting in the dielectric breakdown of the electrodes 32.

An action for reducing the voltage required for startup is described above. However, corresponding effects can be exhibited even by a conventional technique of coating the light emitting part with a conductive coating film, in the meaning that the dielectric breakdown between electrodes is promoted by simply utilizing the discharge in the closed space. However, it is found by the inventors of the present invention, that according to the conventional technique of forming the conductive coating film around the light emitting part, the startup characteristics are deteriorated in a period of a product service life. This is because circumference of the light emitting part is an extremely high temperature zone while being lighted, thus vaporizing the conductive coating film which is formed immediately outside thereof, and damaging a function of performing auxiliary discharge, and in addition changing an atmosphere of the closed space, with components of the conductive coating film as impurities, and hardly allowing the discharge to occur.

Accordingly, it is desirable to restrict a range so as not to form the conductive coating film 10 in the light emitting part 11 and in the vicinity of the light emitting part 11 (for example, a neck part of a boundary between the light emitting part and the sealing part).

More specifically, for example, the temperature of the vicinity of a center of the metal foil 31 is lower than the temperature of the light emitting part 11, and therefore the aforementioned problem can be prevented by forming the conductive coating film 10 with this part as a reference. Further, it is a matter of course that the conductive coating film may be formed at a position farther away from the light emitting part 11, within an allowable space.

Figure 23:
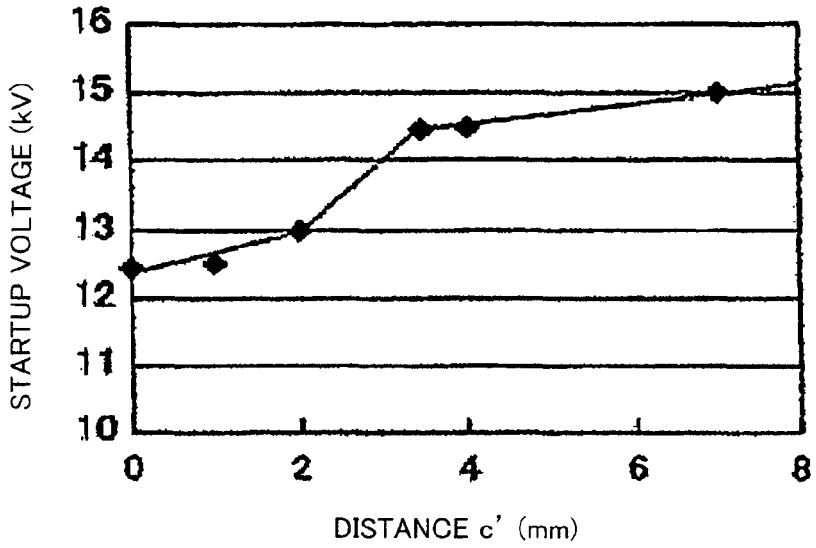
FIG. 23 is a view for describing a startup voltage when a distance c' between the metal band and a conductive film is varied.

Note that as the distance between the conductive coating film 10 and the metal band 71 is set to be shorter, the startup performance can be improved. As shown in FIG. 23, the startup voltage is reduced, as the length in the tube axial direction from the end portion on the tip end side of the lamp of the metal band 71, up to the socket 5 side end portion of the conductive coating film 10, namely the distance c' between the conductive coating film 10 and the metal band 71 is shorter. According to FIG. 23, the distance c between the conductive coating film 10 and the metal band 71 is set to 3.5 mm or less, and preferably set to 2.0 mm or less, to thereby make the startup performance excellent.

In addition, further high effect can be expected by setting both the distance c between the metal foil 31 and the metal band 71, and the distance c' between the conductive coating film 10 and the metal band 71, at suitable positions.

Figure 24:
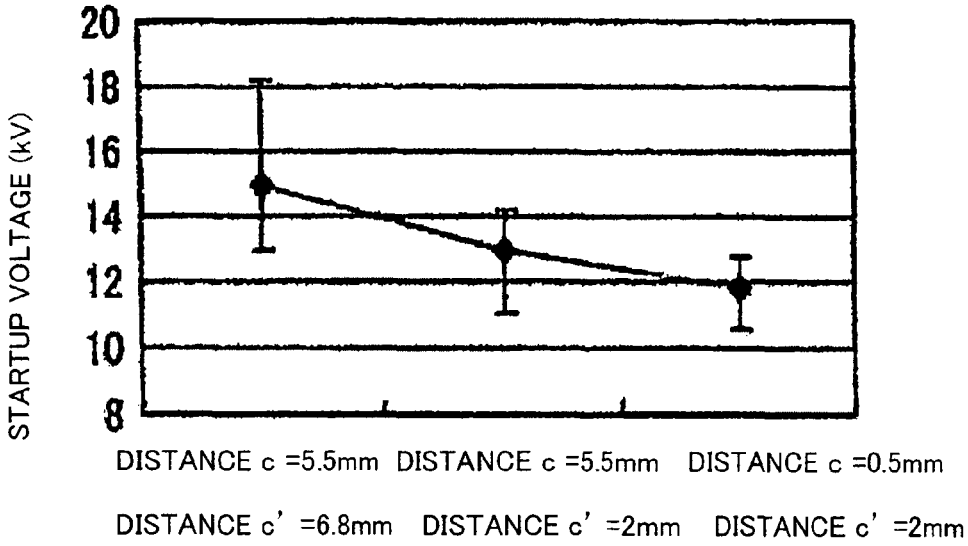
FIG. 24 is a view for describing the startup voltage when the distance c between the metal band and the metal foil is varied, and the distance c' between the metal band and the conductive film is varied.

As shown in FIG. 24, although the startup performance is reduced only by shortening the distance c', the startup performance is further reduced by shortening the distance c as described in the second embodiment. Thus, the distance c between the metal foil 31 and the metal band 71 is preferably set to 2.0 mm or less, and the distance c' between the conductive coating film 10 and the metal band 71 is preferably set to 3.5 mm or less.

Figure 25:
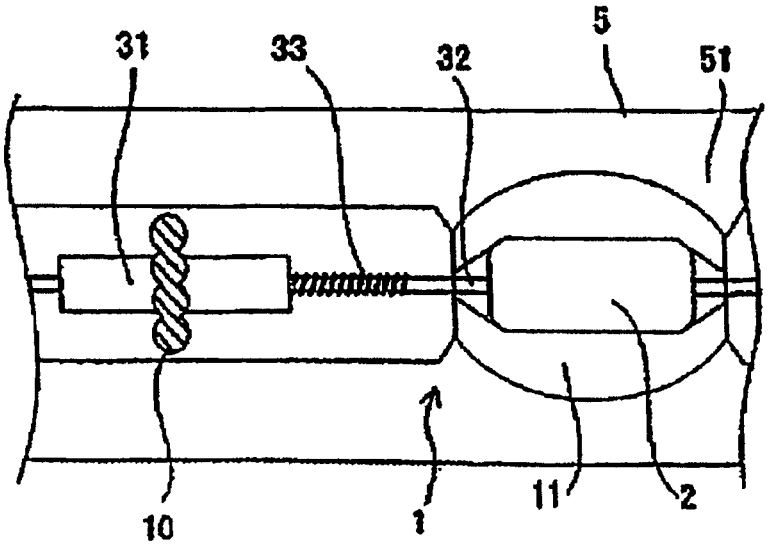
FIG. 25 is an expanded view of the vicinity of a sealing part of the discharge lamp of FIG. 22.

Here, specifically, the conductive coating film 10 of this embodiment is formed by four circular dots so as to be partially overlapped, as shown in FIG. 25. The material is tin oxide, a film thickness is 100 nm, an area is 10 $mm^2$, and a length of an edge is 14 mm. Thus, by forming the conductive coating film 10 by combining a plurality of geometric shapes, a total circumference of the conductive coating film 10 can be sufficiently large in the limited space, and therefore the startup performance can be improved. Of course, not only a plurality of same geometric shapes may be combined, but also a plurality of different geometric shapes may be combined. For example, a conductive coating film formed by combining circles and squares can also be employed.

Although according to the present invention, a forming method of the conductive coating film 10 is not particularly limited, a plurality of dot patterns as shown in FIG. 25 can be formed, for example, by repeatedly performing a process of dropping a liquid material to the sealing part 12 of the inner tube, at varied positions. According to this method, the conductive coating film with desired film thickness and area can be formed by suitably adjusting a viscosity of the material itself and a height of drop when a coating film material is dropped using a publicly-known dispenser. Thus, it is a matter of course that the method for forming a desired shape can be employed by a scientific method such as etching or vapor deposition by masking, in addition to a process of utilizing a diffusion of the material itself.

Figure 26:
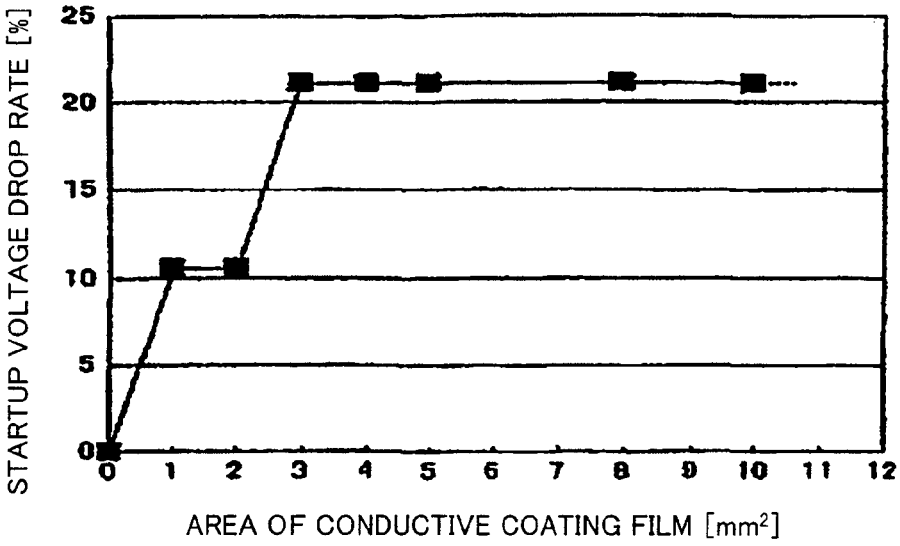
FIG. 26 is a view showing a relation between an area of a conductive coating film and a drop rate of the startup voltage.

FIG. 26 is a graph for plotting actually measured values obtained by examining a relation between areas of the conductive coating film and a drop rate of the startup voltage, with areas of the conductive coating film varied, and the areas of the conductive coating film being formed in the sealing part. As is clarified from this graph, reduction of 20% or more of the startup voltage is achieved by forming the conductive coating film with an area of 3 $m^2$ or more, compared with a case that the conductive coating film is not formed (=0 $mm^2$).

Further, when the test was carried out repeatedly, with conditions changed, it was found that not only the area but also other elements had an influence on the effect of reducing the startup voltage, depending on the shape of the conductive coating film. For example, even in a case of the coating film with same area, when a coating film of a perfect circle, and a coating film of a star shape with outer edge formed irregularly, were compared, it was confirmed that the latter was capable of easily starting the lamp. It can be considered that this is because field concentration occurs in the vicinity of an outer peripheral edge portion of the coating film, and the outer edge becomes a start point of the auxiliary discharge. Therefore, a part to be the start point is increased by making the outer periphery longer. Accordingly, it can be said that in order to achieve a sufficient auxiliary discharge by a required minimum amount of the conductive coating film, a complicated shape such as a combination of a plurality of geometric shapes is preferable, rather than a simple shape such as a square or a perfect circle.

Based on such knowledge, it can be said that the present invention can include various modified embodiments as the embodiments of the conductive coating film formed in the sealing part. Illustrated in FIG. 27 are some of these embodiments.

For example, a conductive coating film 10*a* shown in (a) is formed in such a manner that two circular dots are partially overlapped in zigzag. Wherein, the "dot" called in this specification is not limited to the circle shown in the figure, and for example, it should be interpreted as a concept including ovals, squares such as a rectangle and polygons such as a hexagon, and shapes including irregular shapes such as a star or approximately the star. Namely, as is understood from an ordinary meaning of the "dot", it can be said that the coating film sufficiently smaller than a width of the sealing part 12, for example, covering the whole body of the sealing part 12, and extending to the neck part of the boundary between the sealing part 12 and the light emitting part 11, is excluded from the concept of the "dot" called in this specification.

A conductive coating film 10*b* of (b) is formed by forming two circular dots at positions opposed to the metal foil 31 respectively. In this case, when a prescribed startup voltage is applied, the dielectric breakdown is assisted, with either one of the two coating films set as a start point.

A conductive coating film 10*c* of (c) is formed so that three oblong rectangular films are formed in parallel to a width direction of the metal foil 31. In a case of the conductive coating film 10*c* with small width, field concentration easily occurs at a startup time, and therefore startup at a low voltage is enabled. Note that it is advantageous if the width is smaller, and for example, when the width is 2 mm or less, the startup voltage can be improved by about 1.5 kV, compared with a case that the conductive coating film is simply formed into a rectangular shape.

A conductive coating film 10*d* of (d) is formed having zigzag edge, by being formed into a shape combining a plurality of acute-angled triangles on the end portion. With such a shape, a peripheral length can be tremendously long, more than that of the rectangular conductive coating film with same area. Further, the field concentration occurs at an acute end portion, to thereby enable startup at a low voltage.

Not that in the aforementioned various embodiments, explanation is given for an embodiment that the conductive coating film is arranged to face an interface between the electrode and the metal foil. However, the present invention is not limited to this embodiment. Namely, although the effect of the auxiliary startup is considered to be relatively high generally in a case of a small distance between the metal foil and the conductive coating film, as shown in FIG. 27(*c*) to FIG. 27(*d*), the effect of the auxiliary startup can be obtained by forming the conductive coating film on an opposite side to the sealing part, and further by forming the conductive coating film on both sides. Therefore, in the present invention, which side face of the sealing part is used to form the conductive coating film is not limited, in relation to the metal foil. Further, the conductive coating film 10 may be formed so as to be shifted in a longitudinal direction of the metal foil 31, irrespective of the aforementioned positional relation, and one of the conductive coating films 10 may be formed into a shape different from the shape of the other one.

Further, the present invention is described as the invention that can be applied to the mercury-free discharge lamp substantially not containing mercury as a discharge medium. However, it is no problem in utilizing the present invention similarly in the discharge lamp containing mercury. Namely, it is a general matter that in the mercury-free lamp, the pressure in the discharge space is high, and inter-electrode distance is large, thus requiring further high startup voltage. Accordingly, it can be said that usefulness of the present invention is high, which is capable of reducing the startup voltage. However, there is no problem in applying the present invention to the discharge lamp with mercury, for the similar purpose of improving the startup characteristics.

(Seventh Embodiment)

FIG. 28 is a view of a vehicle discharge lamp according to a seventh embodiment of the present invention, wherein (a) is an expanded view of the vicinity of a sealing part, and (b) is a view of a sectional face taken along the line X-X' shown by one dot chain line, viewed from a direction of arrows.

In this embodiment, a conductive coating film 10*e* is formed, including a protuberance 10*e*1 on the end portion, and a planar portion 10*e*2 formed so as to be surrounded by the protuberance 10*e*1. More specifically, 7 $mm^2$ of the conductive coating films 10*e* are respectively formed on front and rear surfaces where the metal foil 31 of the sealing part 12 positioned at the high-voltage side, with a film thickness of the protuberance 10*e*1 being T1=0.00035 mm, and a film thickness of the planar portion 10*e*2 being T2=0.00015 mm. Thus, by forming the protuberance on the conductive coating film 10*e*, with higher height than a height of the planar portion extending in a direction approximately vertical to a surface, field concentration occurs in the protuberance 10*e*1 at the time of applying the startup voltage, thus easily generating the dielectric barrier discharge. Therefore, the startup performance can be more improved than a case that the conductive coating film 10*e* is simply formed into a planar shape.

The conductive coating film 10*e* including such a protuberance 10*e*1, can be formed by dropping a conductive solution by a dispenser, etc., the conductive solution being obtained by mixing tin oxide and butyl acetates adjusted to obtain a low surface tension, and after sufficiently spreading this solution on the sealing part 12, applying a sintering process thereto using a hydrogen burner, etc. After sintering, most of the components of the butyl acetates are jumped, thus making it possible to obtain a conductive coating film with high transparency and a resistance value of about 100 kΩ.

Note that according to this embodiment, a pattern 311 is formed on a half surface of the electrode 32 side of the surface of the metal foil 31, for suppressing the generation of a crack leak. The pattern 311 is formed by a plurality of non-penetrating semi-circular recesses arranged by irradiation of YVO4 laser for example. Namely, minute irregularities are formed on the surface of a foil as is described in WO2008/129745A1 and WO2007/086527A1, etc. Thus, by forming the conductive coating film 10*e* in the sealing part 12 so as to include the surface of the pattern 311, the polarization immediately after startup is promoted by the irregularities of the pattern 311, and therefore further improved startup performance can be expected.

Regarding a conventional lamp (called conventional embodiment 1 hereafter) in which a conductive film with a uniform film thickness similarly to the lamp of this embodiment (called embodiment 1 hereafter) is formed, whether the lamp was started or not was tested, using a lighting circuit that continuously outputs a voltage waveform with startup pulse voltage=23 kV, and rise time=250 nsec. As a result, it was found that the startup voltage of the lamp of the embodiment 1 had a tendency of reducing the startup voltage rather than the lamp of the conventional embodiment 1. Further, as a result of carrying out the test by increasing the number to 200, it was found that the lamp with inferior startup performance among the tested lamps of the conventional embodiment 1 had a startup pulse voltage of about 18 kV, and meanwhile the lamp of the embodiment 1 had a startup pulse voltage of about 16 kV, even in a case of a lamp with inferior startup performance. Therefore, it can be said that startup variation is small and lighting failure is small in the lamp of the embodiment 1.

Next, test was carried out for the variation of the startup voltage when the relation T1/T2 between the film thickness T1 of the protuberance 10*e*1 and the film thickness T2 of the planar portion 10*e*2 was varied. Results thereof are shown in FIG. 29. Note that the number of tests is 200 respectively, and both the film thicknesses T1, T2 are the thickness of an average part when the film thickness is not constant.

As is clarified from FIG. 29, it is found that as T1/T2 are larger, an average value and a worst value (maximum value of variation) are likely to be small, and particularly the range of T1/T2≧2 is preferable. Namely, a conductive coating film 9 is preferably formed so as to satisfy T1/T2≧2. However, not so much variation is observed in the startup performance in a range of T1/T2≧2. Therefore, T1/T2 is preferably 5 or less, and further preferably 3 or less, in consideration of easiness in manufacture.

In addition, the protuberance 10*e*1 is not limited to the aforementioned embodiment, and a size and a place can be changed. For example, as shown in FIG. 30(*b*), which is a view of a sectional face of FIG. 30(*a*) taken along the line Y-Y' by one dot chain line, a protrusion 121 is formed in the sealing part 12, and the surface of the sealing part 12 is coated with the conductive coating film 10*e* so as to include the protrusion 121, to thereby form the protuberance 10*e*1 in a part other than an edge portion of the conductive coating film 10*e*.

(Eighth Embodiment)

Figure 31A:
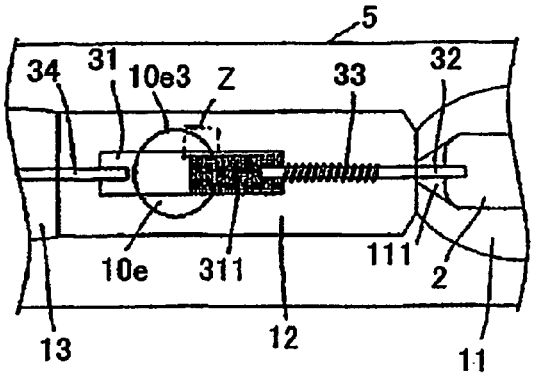
FIG. 31 is a view for describing a discharge lamp according to an eighth embodiment of the present invention.
Figure 31B:
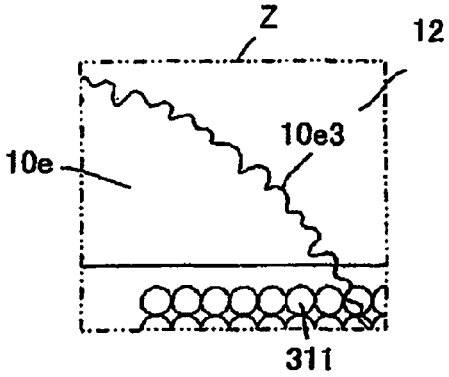

FIG. 31 is a view for describing a vehicle discharge lamp according to an eighth embodiment of the present invention, wherein (a) is an expanded view of the vicinity of a sealing part and (b) is an expanded view of one dot chain line Z.

In this embodiment, a sawteeth part 10*e*3 including a plurality of protrusions protruded to outside in a width direction of a film having a—plurality of burrs like sawteeth, is formed on an edge portion of the conductive coating film 10*e*. Thus, by forming the sawteeth part 10*e*3 on the edge portion of the conductive coating film 10*e*, field concentration easily occurs in the tip end portion thereof. Therefore, the dielectric barrier discharge is easily generated at the time of startup. Further, the length of the edge of the conductive coating film 10*e* becomes long, and therefore the startup performance can be improved by forming the sawteeth part 10*e*3 on the edge portion of the conductive coating film 10*e*. The conductive coating film 10*e* including the sawteeth part 10*e*3 on the edge portion as described above, can be formed by increasing a height of drop of the conductive solution.

Figure 32:
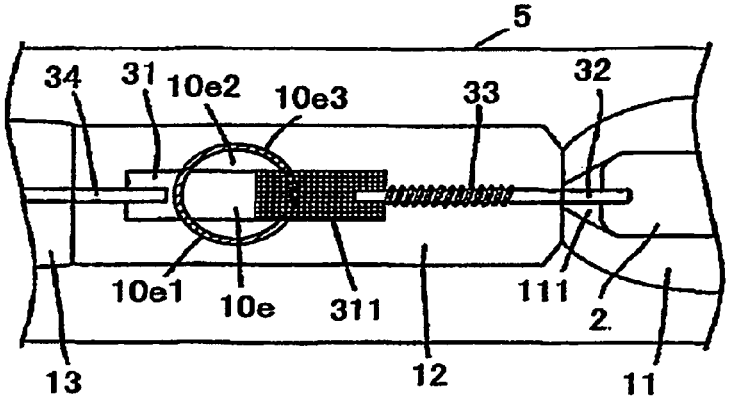
FIG. 32 is a view for describing other embodiment of the conductive coating film.

In addition, it is best suitable to form the conductive coating film 10*e* in a crown shape having both the protuberance 10*e*1 and sawteeth part 10*e*3 as shown in FIG. 32. In this case, the startup voltage can be decreased by about 4 kV, compared with a case of a coating film which is formed into a plane shape, with smooth edge, and having same area. Note that tip end portions of the protuberance 10*e*1 and the sawteeth part 10*e*3 have a pointed shape rather than an arc shape respectively, preferably at an acute angle rather than an obtuse angle. In addition, further much forming numbers are preferable. By employing them, the field concentration further easily occurs, and therefore the startup performance can be further improved.

(Ninth Embodiment)

Figure 33:
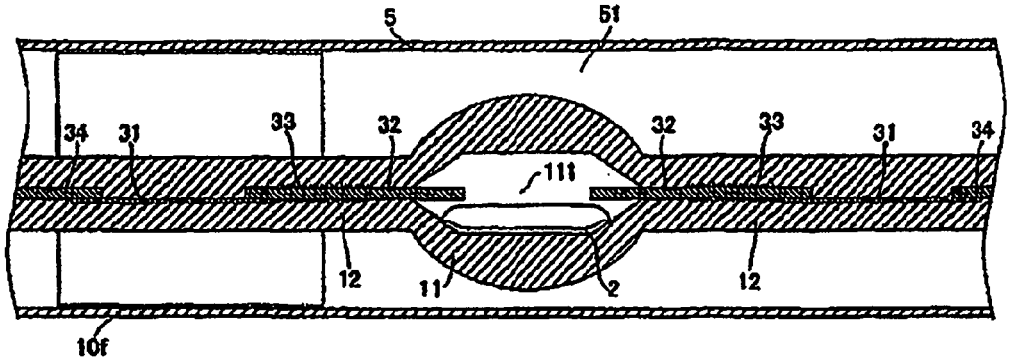
FIG. 33 is a view for describing a discharge lamp according to a ninth embodiment of the present invention.

FIG. 33 is a view for describing a vehicle discharge lamp according to a ninth embodiment of the present invention.

In this embodiment, a conductive coating film 10*f* made of ITO having film thickness=10 nm is formed on an inner surface of the outer tube 5 in the vicinity of the sealing part 12 on the high-voltage side. When the conductive coating film is formed in the outer tube 5, the potential difference between a glass portion of the sealing part 12 and the outer tube 5 portion is increased. Therefore, the startup performance can be improved. Note that the conductive coating film 10*f* can be formed, for example, by a method of sucking the conductive solution into the outer tube 5 and drying the sucked conductive solution, and thereafter removing an unnecessary portion.

(Tenth Embodiment)

Figure 34:
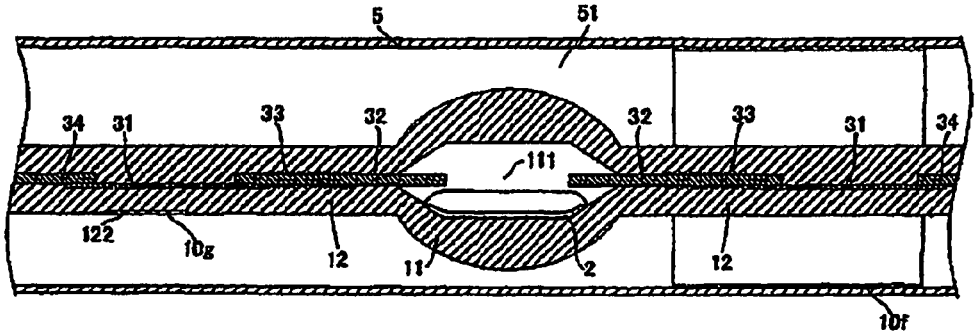
FIG. 34 is a view for describing a discharge lamp according to a tenth embodiment of the present invention.

FIG. 34 is a view for describing a vehicle discharge lamp according to a tenth embodiment of the present invention.

In this embodiment, a conductive coating film 10*f* is formed on the inner surface of the outer tube 5 in the vicinity of the sealing part 12 on a low-voltage side, and a conductive coating film 10*g* is formed on the sealing part 12 on the high-voltage side. Note that the conductive coating film 10*g* has a structure that a recess portion 122 is formed in a sealing part 11, and a coating film is formed on the recess portion 122. Thus, a distance between the conductive coating film 10*g* and the metal foil 31 becomes near, and therefore further high effect can be expected and also the range and the thickness of a film can be easily controlled, thus making it possible to reduce a variation in characteristics. In addition, there is also an advantage that the step of forming the coating film can be facilitated.

A discharge startup voltage of the lamp having this structure is 13.3 kV, and the effect of improving the startup performance is remarkable even if being compared with the discharge lamp of other embodiment. It can be considered that the aforementioned remarkable effect of the improvement in startup is influenced by the generation of the dielectric barrier discharge in the vicinity of the light emitting part 11, which is caused by forming the conductive coating film 10*g* on the high pressure side sealing part 12, and forming the conductive coating film 10*e* on the inner surface of the outer tube 5 in the vicinity of the low pressure side sealing part 12. Accordingly, when the conductive coating film is formed in inner/outer tubes respectively, it may be formed to grasp the light emitting part 11, so that the dielectric barrier discharge is generated in the vicinity of the light emitting part 11.

(Eleventh Embodiment)

Figure 35:
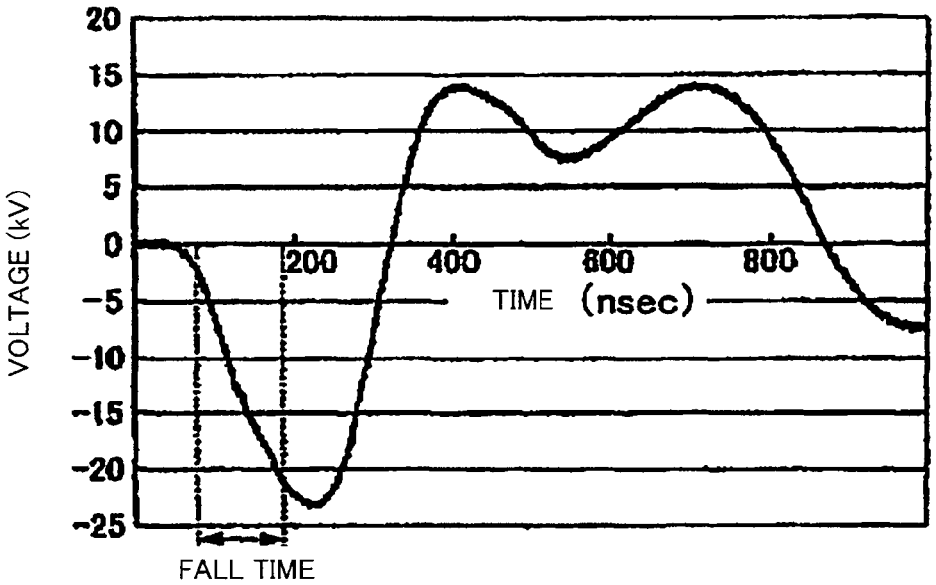
FIG. 35 is a view for describing a discharge lamp according to an eleventh embodiment of the present invention.

FIG. 35 is a view for describing a vehicle discharge lamp device according to an eleventh embodiment of the present invention.

In this embodiment, a high-voltage pulse of negative polarity is applied to the high-voltage side sealing part having a conductive coating film formed thereon. With this structure, the generation of the dielectric barrier discharge can be assisted as will be described later, and therefore startup variation of the lamp can be reduced. The "high-voltage pulse of negative polarity" means the pulse generated on the negative side immediately after application, as shown in FIG. 35. Whereby, whether the polarity is negative polarity or positive polarity can be judged by observing a waveform obtained by connecting an oscilloscope OS to a circuit portion connected to the high-voltage side of the lamp. Note that in this embodiment, a peak value of a pulse wave=24 kV, being a fall time, namely, the time of a high-voltage pulse required for changing the pulse waveform to 10% to 90% of the peak value of the pulse wave, expressed by the time of the high-voltage pulse=110 ns. Such a pulse can be generated by reversing a winding direction of the transformer.

Regarding a plurality of discharge lamp devices of this embodiment (embodiment 2, hereafter), and a plurality of discharge lamp devices for applying high-voltage pulse of positive polarity (conventional embodiment 2, hereafter) respectively, a test for measuring the startup voltage and a variation thereof, was carried out. Results thereof are shown in FIGS. 36(*a*) and (*b*).

As is clarified from the results, an average value of the startup voltage is equal in both the embodiment 2 and the conventional embodiment 2, or slightly smaller in the conventional embodiment 2. However, as is clarified from a value of a standard deviation, the startup voltage is smaller in the embodiment 2. This is because by applying the high-voltage pulse of negative polarity, γ-effect of discharging secondary electrons from the surface of the conductive coating film can be obtained. Namely, in the embodiment 2, the generation of the dielectric barrier discharge is assisted. Therefore, it can be considered that the probability of startup is increased, and the variation is reduced. When the startup variation is thus reduced, there is no necessity for designing a transformer with good margin in output of the pulse, and therefore miniaturization of the transformer and reduction of a cost are achieved. Note that further high effect can be expected when the conductive coating film is formed on both sides of the sealing part.

Figure 36A:
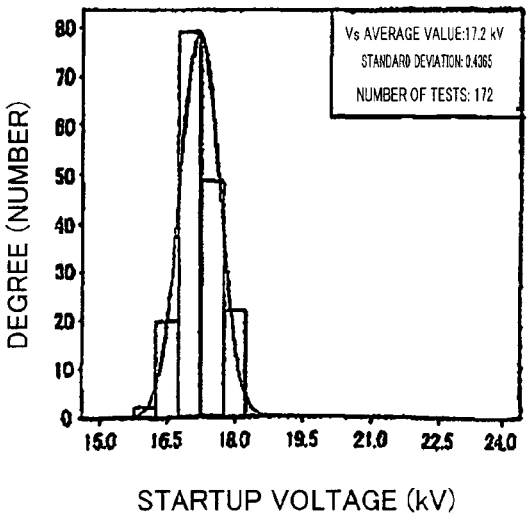
FIG. 36 is a view for describing a variation of the startup voltage, when a high voltage pulse of negative polarity is applied to a lamp in which a conductive coating film is formed, or a high voltage pulse of positive polarity is applied thereto.
Figure 36B:
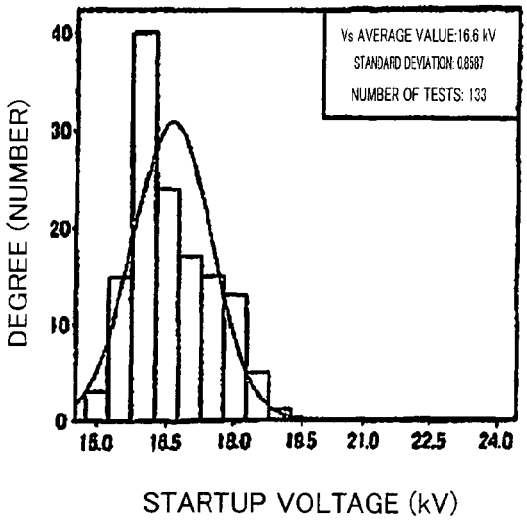
Figure 37A:
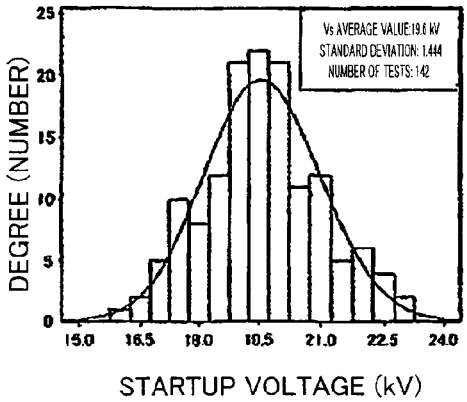
FIG. 37 is a view for describing a variation of the startup voltage, when a high voltage pulse of negative polarity is applied to a lamp in which a conductive coating film is not formed, or a high voltage pulse of positive polarity is applied thereto.
Figure 37B:
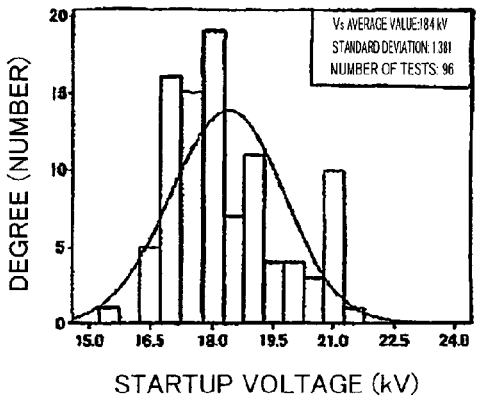

FIG. 36(*a*) shows a startup voltage distribution when a high-voltage pulse of positive polarity is input, and (*b*) shows a startup voltage distribution when the high-voltage pulse of negative polarity is input, into a lamp without conductive coating film. As is clarified from the results, even if the high-voltage pulse of negative polarity is input into the lamp without conductive coating film, both the startup voltage and the variation are poorer than a case of the high-voltage pulse of positive polarity. Therefore, in the discharge lamp without conductive coating film, it is general that the high-voltage pulse of positive polarity is supplied. In the lamp in which gas is sealed in the space and which has the conductive coating film formed on the surface of the high-voltage side sealing part, it can be said that the structure of inputting the high-voltage pulse of negative polarity is unexpected and also results of FIG. 36(*a*) are unexpected.

Figure 38:
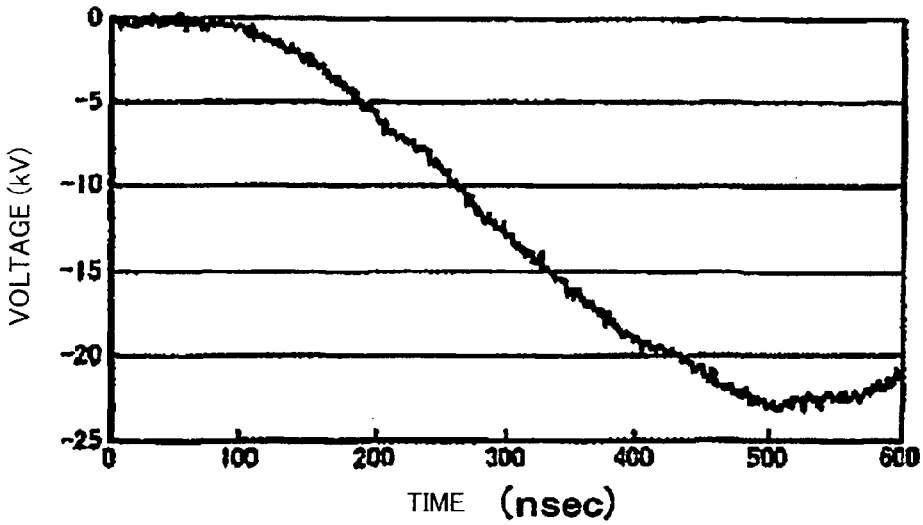
FIG. 38 is a view for describing the high voltage pulse with fall time of about 300 ns.

Next, the variation of the startup voltage was tested, with the fall time varied, which is the fall time of the high-voltage pulse of negative polarity applied to the lamp. As a result, it was found that the average startup voltage and the variation were varied depending on the fall time. For example, as shown in FIG. 38, when the high-voltage pulse with fall time of about 300 ns was applied, although the average value of the startup voltage was slightly decreased compared with a case that the fall time was about 110 ns, the standard deviation was increased by 1.5 times. Namely, when a startup variation is reduced, it is suitable to set the fall time shorter, and therefore from the results of various tests, the fall time of the high-voltage pulse of negative polarity, is preferably set to 180 ns or less, and further preferably set to 110 ns or less.

Note that this embodiment is further effective by combining it with the following structure.

(A) Argon is sealed in the space 51.

When argon and nitrogen are compared, argon is easily ionized. Namely, argon is the gas having low ionizing energy, and therefore when the high-voltage pulse of negative polarity is applied at a startup time, a discharge amount of the secondary electrons is increased, and the dielectric barrier discharge is easily generated. Note that rare gas such as neon and xenon corresponds to the gas with low ionized energy. However, neon easily escape from the space 51 during its service life when the temperature of the light emitting part 11 is excessively decreased, and xenon and krypton are not suitable for a practical use, because the temperature of the light emitting part 11 is excessively increased. Meanwhile, it is most suitable to use argon, because argon is capable of further improving the startup performance by γ-effect, while maintaining the temperature of the light emitting part 11 to be uniform. Note that argon is not limited to a single body, and when a major part, for example, 90% or more of the whole body is occupied by argon, it can be said that argon is most suitable to be used. Further, the pressure of gas is preferably set to 0.3 atm or less, and further preferably set to 0.1 atm or less.

(B) Combination with conductive coating films as shown in the seventh and eighth embodiments.

When combined with the conductive coating film including the protuberance and/or the sawteeth part as shown in FIG. 32, the dielectric barrier discharge is easily induced by an increase of a concentration of electrons under γ-effect, and by the field concentration on the tip end portion of the conductive coating film, and therefore the startup performance is improved.

(C) High-voltage pulse of positive polarity is applied to one of the electrode mounts 3, and high-voltage pulse of negative polarity is applied to the other electrode mount 3 at a startup time (called both high-voltage startup hereafter).

Figure 39:
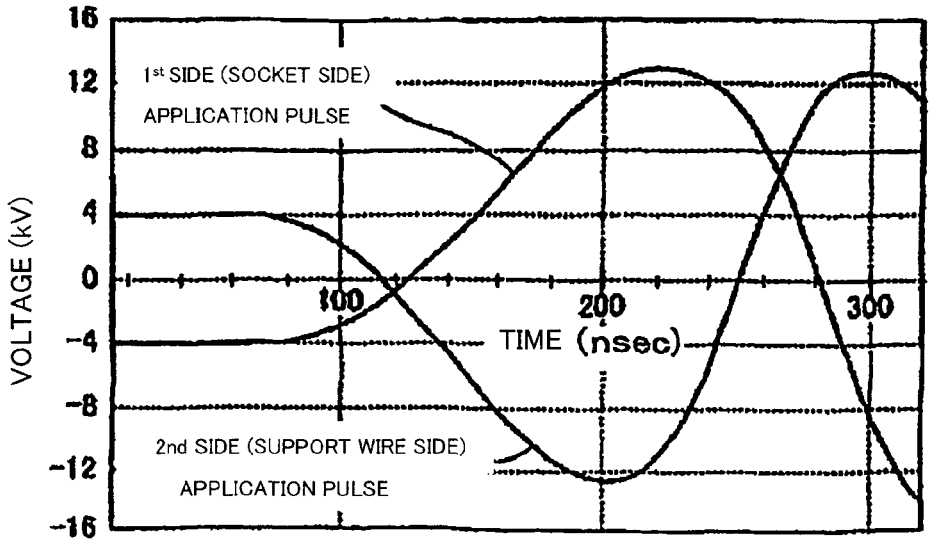
FIG. 39 is a view for describing an applied high voltage pulse at the time of carrying out both high voltage startup.

As shown in FIG. 39, with a structure of the both high-voltage startup, the circuit can be miniaturized and insulation can be easily secured, while maintaining excellent startup performance. For example, when the high-voltage pulse is applied only to one side, and in a case of the lamp requiring high-voltage pulse of 20 kV for startup, the lamp is started only by applying 10 kV of the high-voltage pulse to one side, which is about half of 20 kV, and therefore two transformers with small output can be substituted therefore. Since such a transformer is small in size, a degree of free design of an arrangement of circuit members is increased, and the insulation can be easily secured, thus realizing a cost reduction. Such an advantage is meaningful in a case that the size is limited in a device, such as a lighting circuit combined type vehicle discharge lamp device as shown in FIG. 19. Note that when the structure of both high-voltage startup is employed, it is most suitable to employ a waveform structure in which only polarity is inverted while the phase is same.

Here, peak values of the high-voltage pulse of positive/negative polarities are not necessarily the same values, and may be changed as desired, like the peak value of the high-voltage pulse satisfying the peak value of a $1^{st}$ side (socket side) high-voltage pulse>the peak value of a $2^{nd}$ side (support wire side). In a case of the vehicle headlight, a metal member called a shade for controlling light distribution is disposed in the vicinity of the tip end portion of the lamp, thus involving a problem that when the high-voltage pulse is applied to the support wire 34 side, the voltage leaks to the shade. However, if the rate of the peak value of the high-voltage pulse on the $2^{nd}$ side (support wire side) is decreased, generation of the leak can be suppressed.

The present invention described above can be utilized as an illumination device for various purposes of use, such as vehicle headlamp, fog lamp, and other vehicle illumination or outdoor lamp, capable of achieving the light emission efficiency and service life characteristics equivalent to those of a conventional product, while achieving low power consumption.

The invention claimed is:

1. A vehicle discharge lamp substantially not using mercury, comprising:

a light emitting part in which a discharge space is defined and into which a discharge medium including metal halide and rare gas are sealed; and a pair of electrodes arranged in the discharge space, wherein a spherical length b, which is a length in a tube axial direction of the light emitting part, is 7.5 mm to 8.5 mm and a thickness volume V of the light emitting part is 50 $mm^3$ to 100 $mm^3$, and wherein the following formula is satisfied:

$$-20 \leqq (a-35)\times 5.5+(x-13.5)\times 10+(1.85-t)\times 100+(2.5-d)\times 100 \leqq 20$$

wherein a: power [W] supplied in a stable lighting time, satisfying:

$$22<a\leqq 26$$

x: pressure [atm] of rare gas sealed in the discharge space and ranging 10~17 atm t: thickness [mm] of a part where a wall thickness of the light emitting part is maximum and ranging 1.3~1.85 mm d: inner diameter [mm] of a part where the wall thickness of the light emitting part is maximum.

2. The vehicle discharge lamp according to claim 1, wherein the electrodes are thoriated tungsten electrodes containing 0.1 wt % to 0.5 wt % of thorium oxide.

3. The vehicle discharge lamp according to claim 1, wherein an outer tube is provided to cover the light emitting part, gas is sealed in a closed space formed between the light emitting part and the outer tube, heat conductivity λ of the gas is 0.01 to 0.03 W/m·K, and a distance D between a part where an outer diameter of the light emitting part is maximum and an inner surface of the outer tube is 0.5 to 1.0 mm.

4. The vehicle discharge lamp according to claim 1, wherein metal foils are sealed to sealing parts formed on both ends of the light emitting part, a metal member is provided on an outer peripheral surface of an outer tube which is provided to cover the light emitting part, with a closed space formed between them filled with gas, and a distance c in a tube axial direction between the metal foils and the metal member is 2.0 mm or less.

5. The vehicle discharge lamp according to claim 1, further comprising:

an inner tube having a sealing part and a light emitting part having a discharge space inside;

a discharge medium sealed into the discharge space;

an electrode mount air-tightly sealed to the sealing part; and an outer tube provided to cover the light emitting part, wherein a closed space formed between the inner tube and the outer tube is filled with gas, and a conductive coating film is formed on a surface of the sealing part.

6. The vehicle discharge lamp according to claim 5, wherein a metal member is provided on an outer peripheral surface of the outer tube, and a distance c' between the conductive coating film and the metal member is 3.5 mm or less.

7. The vehicle discharge lamp according to claim 5, wherein the electrode mount includes a metal foil air-tightly sealed to the sealing part, and the conductive coating film extends at least along a surface opposed to the metal foil, in a form that a plurality of geometric shapes are combined.

8. The vehicle discharge lamp according to claim 5, wherein the conductive coating film includes at least one of:

a protuberance with a film thickness formed to be large and, a sawteeth part including a plurality of protrusions on an edge portion in such a manner as protruding to outside in a width direction of a film.

9. A vehicle discharge lamp device, further comprising:

the vehicle discharge lamp according to claim 5; and a lighting circuit for lighting the vehicle discharge lamp, wherein in the lighting circuit, a high-voltage pulse of negative polarity is generated at a startup time, and the generated high-voltage pulse is applied to the discharge lamp.

10. A vehicle discharge lamp device, further comprising:

the vehicle discharge lamp according to claim 1; and a lighting circuit for lighting the vehicle discharge lamp, wherein the lighting circuit includes a ballast circuit that outputs an AC current with a current slope of a zero cross current being 0.05 A/μs or more while being lighted in a stable lighting time from polarity inversion to a point when a current reaches 0.2 A, and a sectional area of a current that flows to the electrode of the discharge lamp while being lighted in a stable lighting time, is 6 to 15 $A/mm^2$.

11. A lighting circuit combined type vehicle discharge lamp device, further comprising:

a burner of the vehicle discharge lamp according to claim 1; and a circuit part that holds the burner on a front end side, wherein the vehicle discharge lamp is configured to be lighted, with a tube axis set in approximately a horizontal state, the circuit part further including:

a case;

a transformer;

a first circuit element group that generates a high-voltage pulse using the transformer, and starts the burner;

a second circuit element group that supplies a rated power to the burner; and a connector disposed in such a manner as protruding from the case, wherein the transformer is disposed on a front end side in the case.

12. A lighting circuit for lighting the vehicle discharge lamp according to claim 1, further comprising:

a ballast circuit that outputs an AC current with a current slope of a zero cross current being 0.05 A/μs or more while being lighted in a stable lighting time from polarity inversion until a point when a current reaches 0.2 A.

* * * * *